US005446929A

United States Patent [19]

Sills et al.

[11] Patent Number: 5,446,929

[45] Date of Patent: Sep. 5, 1995

[54] BATH TUB HAVING SIDE ACCESS

[75] Inventors: Arthur A. Sills, Traverse City; Frederick A. Kilbourn; Brian K. Nelson, both of Suttons Bay; Donald J. Henderson, Traverse City, all of Mich.

[73] Assignee: Siltech Products, Inc., Traverse City, Mich.

[21] Appl. No.: 89,890

[22] Filed: Jul. 12, 1993

Related U.S. Application Data

[63] Continuation-in-part of Ser. No. 910,775, Jul. 8, 1992, Pat. No. 5,351,345.

[51] Int. Cl.[6] ..... A47K 3/022

[52] U.S. Cl. ..... 4/555; 4/557

[58] Field of Search ..... 4/555, 556, 558, 557, 4/607, 610

[56] References Cited

U.S. PATENT DOCUMENTS

| | | |
|---|---|---|
| D. 261,796 | 11/1981 | Queen . |
| D. 270,658 | 9/1983 | Sills et al. . |
| D. 273,700 | 5/1984 | Parker . |
| 2,018,728 | 5/1937 | Bassett . |
| 2,569,825 | 10/1951 | Otis . |
| 2,570,053 | 10/1951 | Fowler et al. . |
| 2,576,623 | 11/1951 | McLaughlin . |
| 2,587,335 | 2/1952 | Landergott . |
| 2,804,629 | 9/1957 | Ring . |
| 2,936,463 | 5/1960 | Tracy . |
| 2,977,604 | 4/1961 | Miller . |
| 3,066,316 | 12/1962 | Russell . |
| 3,101,485 | 8/1963 | Kirshenbaum . |
| 3,113,323 | 12/1963 | Beardsley . |
| 3,366,978 | 2/1968 | Jones . |
| 3,371,354 | 3/1968 | Hayslett . |

(List continued on next page.)

FOREIGN PATENT DOCUMENTS

| | | |
|---|---|---|
| 921653 | 2/1973 | Canada . |
| 1054752 | 5/1979 | Canada . |
| 1177603 | 11/1984 | Canada . |
| 1214603 | 12/1986 | Canada . |
| 1214604 | 12/1986 | Canada . |
| 1254703 | 5/1989 | Canada . |
| 0123325 | 10/1984 | European Pat. Off. . |
| 2434617 | 3/1980 | France . |
| 89071838 | 4/1970 | Monaco . |

OTHER PUBLICATIONS

European Search Report dated Dec. 2, 1993, and including Patent family list.

*Primary Examiner*—Henry J. Recla
*Assistant Examiner*—Charles R. Eloshway
*Attorney, Agent, or Firm*—Learman & McCullouch

[57] ABSTRACT

The bath tub (10) having side access has a main tub body (12), a door support, a tambour door assembly (16), a door seal 18 and a control system (20). The door support includes door guide assemblies (64). A tambour door (66) with a plurality of tambour slats (76 or 401) and a flexible impervious membrane (86) is guided by the door guide assemblies (64). The tambour door (66) is in a horizontal position under the floor (27) when it is open and in a vertical position closing the open side (28) of the main tub body (12) when it is closed. A seal (18) seals between the main tub body and the membrane (86). The seal (18) includes a tube (155) that is inflated to seal between the main tub (12) and the tambour door (66). The control system (20) closes the drain 46 when the tambour door (66) is closed and the seal (18) is inflated and the tambour door (66) is constrained in the closed position. The tambour door is constrained in the closed position until the control system 48 senses that the water level in the tub has dropped below a predetermined level and the seal (18) is deflated. A valance (114) limits movement of the tambour door (66) away from the seal (18).

12 Claims, 14 Drawing Sheets

OTHER PUBLICATIONS 3,380,078 4/1968 Hanson .
3,416,166 12/1968 Hanson .
3,423,769 1/1969 Cowley .
3,562,821 2/1971 Queen .
3,604,018 9/1971 Moran .
3,662,409 5/1972 Johansson .
3,663,971 5/1972 Bonhote .
3,703,733 11/1972 McLoughlin .
3,719,960 3/1973 Russell .
3,736,924 6/1973 Jacuzzi et al. .
3,863,275 2/1975 Brendgord et al. .
3,924,278 12/1975 Ekman .
4,099,272 7/1978 Sowder .
4,112,524 9/1978 Johansson .
4,118,810 10/1978 Brickhouse et al. .
4,171,545 10/1979 Kann .
4,346,485 8/1982 Reed et al. .
4,365,367 12/1982 Houle et al. .
4,399,569 8/1983 Houle .
4,439,877 4/1984 Houle .
4,446,586 5/1984 Reed et al. .
4,523,341 6/1985 Queen .
4,546,506 10/1985 Houle et al. .
4,583,251 4/1986 Karl et al. .
4,592,099 6/1986 Zellner .
4,993,087 2/1991 Roquebrune .

BATH TUB HAVING SIDE ACCESS

This application is a continuation-in-part of application Ser. No. 910,775, filed Jul. 8, 1992, now U.S. Pat. No. 5,351,345.

TECHNICAL FIELD

The invention relates to bath tubs, and more particularly to bath tubs with side access to facilitate ingress and egress.

Side access is advantageous for physically challenged individuals and others who desire to avoid climbing over the side of a tub, to reduce the possibility of a fall while entering or exiting the tub, and to facilitate lateral transfers into or out of the tub.

BACKGROUND OF THE INVENTION

Bath tubs with side doors that can be lifted up to a storage position above the main tub section are commercially available. These bath tubs function well and are found in many hospitals and nursing homes. The overhead door storage requires overhead storage space, a track system to guide and support the door, and a lift system to lift the door to the storage position. These bath tubs require more space than is available in most home bathrooms. They are also too large to be moved into existing home bathrooms even if the bathroom is large enough to house the tub and door assembly. The track system and the door lift systems add substantial complexity and cost to the bath tub units.

Bath tubs with side doors that are hinged to a main tub section have been known for many years. Hinged doors often provide limited access to a tub, require an elaborate latching system and, in at least some cases, leak. The force exerted against a bath tub side door depends upon the depth of the water and the surface area of the door in contact with the water. Hinged bath tub doors generally have a reduced area to limit the total force applied against the doors. It is also common for the doors to have a bottom edge that is above the bottom wall to further reduce the total force applied against the door. Reduced door size impedes bath tub ingress and egress and renders such bath tubs unusable by some individuals. A space for a hinged door to swing outwardly away from the main portion of a tub during opening and closing must be provided. The door must have room to move into a position in which it does not block movement of a bather who is moving to or from the tub. Hinged doors compress door seals, slide along the surface of portions of seals, and may rotate on the surface of a portion of a door seal. Sliding contact with untreated seals causes seal wear and may lead to leaks.

Bath tubs with side doors that slide up and down have been proposed. Such doors may be difficult to open and close and require special sealing systems to prevent leaks. Operation of levers and cams that are part of the sealing system may require substantial dexterity.

SUMMARY OF THE INVENTION

An object of the invention is to provide a bath tub having side access with a full-width tambour door for opening and closing the access opening.

Another object of the invention is to provide a bath tub with a full-width tambour door for side access that is positioned under the tub floor when it is open.

A further object of the invention is to provide a bath tub with a full-width door for side access with an inflatable seal.

A still further object of the invention is to provide a retainer system that limits horizontal movement of the tambour door away from the main tub section when the tambour door is closed.

Yet another object of the invention is to provide a bath tub having side access with a tambour door assembly mounted on a support frame that can be moved away from the main tub section for cleaning and maintenance.

A yet further object of the invention is to provide a bath tub having side access and an access door with a control system that closes the drain by inflating an inflatable drain bellows after the door is closed and the seal is inflated and that will allow the door to be opened when the water is drained and the tub seal is deflated.

A yet still further object of the invention is to provide a bath tub with a tambour door, an inflatable seal and a valance with a mechanism that allows the tambour door and the valance to move into contact and out of contact with each other.

The bath tub of the present invention has a main tub body with a fixed side wall, two fixed end walls, a bottom wall, and an open side. If desired, a seat for supporting a bather in a sitting position can be an integral part of the tub. A tambour door and a track assembly are connected to the main tub body. The tambour door includes a plurality of tambour slats and a flexible impervious membrane attached to the tambour slats. The track assembly guides the tambour door between a horizonal position under the tub floor and a generally vertical position adjacent to the open side and in which the tambour door closes the open side.

A tub seal is provided between the main tub body and the tambour door to prevent water leaks. The tub seal includes a tubular cavity that can be inflated to seal tightly. The tub seal also includes a lip seal that is actuated by water pressure.

The tambour door and track assembly can be connected to the main tub body by a support frame or they can be connected directly to the main tub body. The support frame is slideably attached to the main tub body by slide mechanisms. A valance is a part of the support frame and can limit lateral movement of the tambour door away from the main tub body. Interfitting lock members can also be provided to limit lateral movement of the tambour door if desired.

The support frame with the tambour door, a track assembly, and a valance can also be pivotally attached to the main tub body rather than being attached by slide mechanisms. When the support frame is pivotally attached rather than slideably attached to the main tub body, the tambour door must not be in the fully open horizontal position under the tub floor. In the fully open position the tambour door will contact the bottom of the floor and limit pivotal movement of the support frame. When the tambour door is in a vertical closed position, the upper part of the support frame can pivot away from the main tub body and the portions of the support frame that support the horizontal track for the tambour door can pivot upwardly inside cavities formed in each end wall of the main tub body.

Another arrangement is to mount the vertical channels of the door guide assemblies and the arcuate channels on a valance that is pivotally attached to the main tub body and to attach the horizontal channels of the door guide assemblies to the main tub body. With this arrangement, the tambour door must be in a vertical closed position when the valance is released and pivoted away from the main tub body for cleaning and maintenance.

A further arrangement of the door guide or track assemblies is to mount the horizontal guides, the vertical guides and the curved guides which guide the tambour slats between the horizontal guides and the vertical guides directly on the main tub or enclosure section. The valance is pivotally attached to the main tub section. Latches are provided to hold the valance in a closed position. The valance contacts the tambour door to limit horizontal movement of the tambour door away from the main tub section when the seal is pressurized. The tambour door transfers the force of water against the impervious membrane to the valance. The track assemblies can be mounted to the main tub section by a mounting system that permits limited horizontal movement of the track assemblies and that urges the tambour door toward the seal. This system limits the force exerted on the track assemblies and moves the tambour door out of contact with the valance when water has been drained from the tub and the seal has been depressurized. A stop is provided which stops rotation of the sprockets which are in mesh with the tambour door when the tambour door is in the fully closed position. The tambour door can be manually lifted out of the vertical guides when the sprockets are held from rotating, in the direction that closes the door, by the stop.

A control system is provided for closing the drain, holding the tambour door in a closed position, pressurizing the door seal, and indicating that the tub is ready to be filled. The control system can be activated to open the tub drain, and after the water level in the tub has dropped sufficiently, to allow compressed fluid to escape from the tub seal and release the tambour door.

Further objects, features, and other aspects of this invention will be understood from the following detailed description of a preferred embodiment thereof as illustrated in the accompanying drawings.

THE DRAWINGS

FIG. 1 is a perspective view of the bath tub with the tambour door open;

FIG. 2 is a perspective view of the bath tub with the tambour door closed;

FIG. 3 is a perspective view of the bath tub with the support frame for the tambour door moved horizontally away from the main tub body on slide mechanisms and the tambour door removed to show the support frame;

FIG. 4 is an enlarged, fragmentary, sectional view of a lower portion of the valance taken along line 4—4 in FIG. 3;

FIG. 5 is an enlarged sectional view of one of the slide mechanisms taken along line 5—5 in FIG. 3;

FIG. 6 is an enlarged, fragmentary sectional view of the bath tub with the tambour door in the closed position taken along line 6—6 in FIG. 2;

FIG. 7 is an enlarged end view of the tambour slat taken at the circled area 7 in FIG. 6;

FIG. 8 is a fragmentary sectional view of a tambour slat taken along line 8—8 in FIG. 7;

FIG. 9 is an enlarged, fragmentary sectional view of the tub seal and the tambour door membrane taken along line 9—9 in FIG. 3;

FIG. 10 is an enlarged, fragmentary sectional view of one end of a tambour slat and the support frame taken along line 10—10 in FIG. 6;

FIG. 11 is an enlarged, fragmentary side elevational view of one of the L-shaped support frame members, the take-up spring system, and the drip pan;

FIG. 12 is a fragmentary sectional view of an L-shaped support frame member taken along the line 12—12 in FIG. 11;

FIG. 13 is a fragmentary view of one end of the main tub section with the valance removed showing an alternate system for locking the tambour door to the main tub section when the tambour door is closed;

FIG. 14 is an enlarged vertical view of two of the retainer tabs for locking the tambour door to the main tub section;

FIG. 15 is an enlarged, fragmentary, sectional view of one of the tambour slats and a portion of the membrane attached to the tambour slat;

FIG. 16 is a diagrammatic view of the control system for the bath tub;

FIG. 17 is a fragmentary sectional view of the bath tub with the support frame and the valance for the tambour door pivotally attached to the main tub section taken along line 17—17 in FIG. 2;

FIG. 18 is a fragmentary sectional view of the bath tub with the pivotally attached support frame and valance partially opened taken along line 18—18 in FIG. 17;

FIG. 19 is an enlarged, fragmentary sectional view similar to FIG. 9 showing a one piece seal that can be used in place of the two piece seal;

FIG. 20 is a fragmentary sectional view of the right hand end of the tub with the track assemblies mounted directly on the main tub section taken along line 20—20 in FIG. 2;

FIG. 21 is a side elevational view of the stop assembly taken along line 21—21 in FIG. 20;

FIG. 22 is a side elevational view of one of the track assemblies taken along line 22—22 in FIG. 20;

FIG. 23 is a rear view of one of the track assemblies;

FIG. 24 is an end view of a modified slat for the tambour door; and

FIG. 25 is a fragmentary sectional view of a modified seal.

DESCRIPTION OF THE DRAWINGS

The bath tub 10 having side access includes a main tub body generally designated 12, a door support frame 14, a tambour door assembly 16, a door seal 18, and a control system 20. The main tub body 12 is an integral rigid section with a side wall 22, a first end wall 24 integrated with one end of the side wall 22, a second end wall 26 integrated with the other end of the side wall 22, a floor 27, and an essentially open side generally designated 28. The main tub section 12 is made from fiberglass reinforced plastic or some other durable rigid non-corrosive material. The side wall 22 is filled with a rigid structural foam to increase rigidity. The end walls 24 and 26 are partially filled with the same foam for increased rigidity, but have cavities 30 to accommodate the door support frame 14 for the tambour door assembly.

A molded fiberglass seat 32 can be formed in one end of the main tub body 12 if desired or the main tub body can be open to allow a bather to lie down in the tub. If a seat 32 is provided, it has a back 34, a seat part 36, an optional trough 38 in the center of the seat for water drainage, and a kick wall 40. An optional trough 39 between the side wall 22 and the seat 32, and between the end wall 26 and the seat, as shown in FIG. 3, can be provided for water drainage if desired, in addition to or in place of the trough 38. The back 34, the seat 36, and the kick wall 40 are an integral part of the main tub body 12 and form a portion of the side wall 22, the end wall 26, and the floor 27. The floor 27 has a raised side section 44 and a drain 46. The raised side section 44 directs water from the open side 28 toward the drain and allows the tambour door assembly 16 to be opened while the water is still draining from the surface of the tub 10. The raised side section 44 is above the floor 27 a few inches and a bather's feet have to be raised up over the raised side section 44 to enter and exit the bath tub 10. The raised side section 44 is preferably raised less if the main tub body 12 is open to allow a bather to lie down. However, the raised side section 44 is raised some and the entire floor 27 slopes toward the drain 46.

Figure 1:
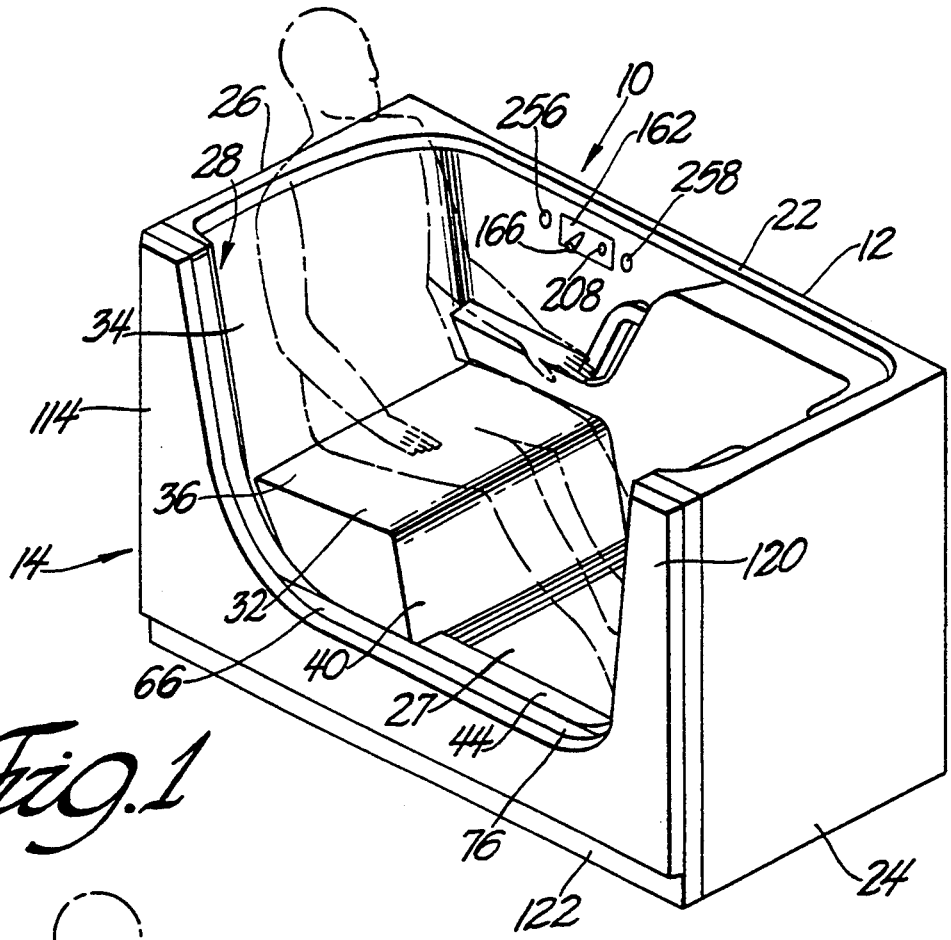
Figure 2:
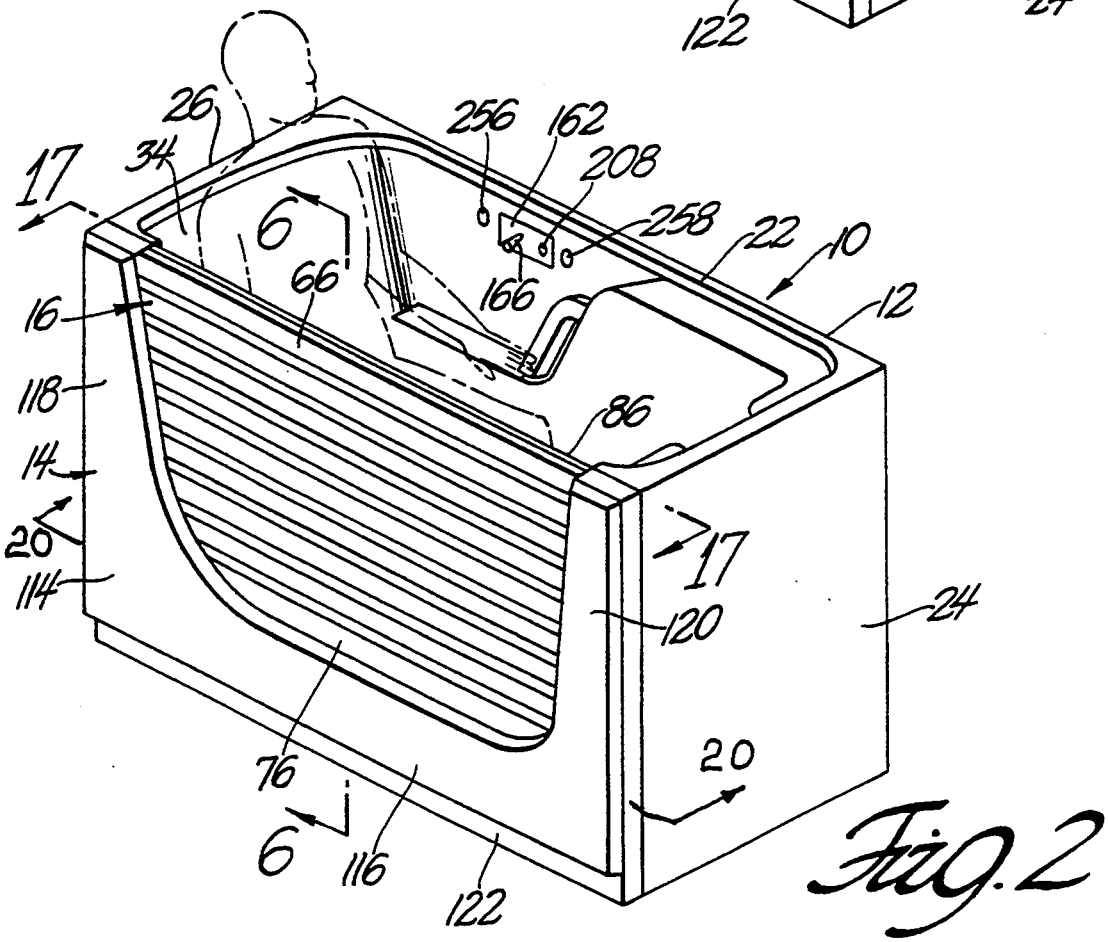

The open side 28 of the main tub body 12 is defined by a sealing surface 48. As shown in the drawing, the sealing surface 48 is in a generally vertical flat plane. If desired, the sealing surface could be in a plane that is inclined away from vertical. The sealing surface could also be arcuate rather than in a flat plane if necessary to produce the desired tub wall shape.

The door support frame 14, in one embodiment of the invention, includes a generally L-shaped support frame member 52 supported on the first end wall 24 and a generally L-shaped support frame member 50 supported on the second end wall 26. The generally L-shaped support frame members 50 and 52 are supported on the first and second end walls 24 and 26 by industrial drawer slides generally designated 54. The drawer slides 54 include a channel member 56 attached to each of the generally L-shaped support frame members 50 and 52, a floating C-shaped channel 58 inside each channel member 56, and a channel member 60. One of the channel members 60 is attached to an inside surface of the first end wall 24 inside one of the cavities 30. The other channel member 60 is attached to an inside surface of the second end wall 26 inside the opposite cavity 30. A plurality of ball bearings 62 are inserted in races formed between the channel member 56, and the floating C-shaped channel 58, and ball bearings 59 are inserted in races formed between the channel 60 and the floating C-shaped channel 58 of each drawer slide to support the L-shaped support frame members 50 and 52 and to allow the L-shaped support frame members to slide in and out of the cavities 30.

The tambour door assembly 16 is attached to the generally L-shaped support frame members 50 and 52 of the door support frame 14. The tambour door assembly 16 includes door guide assemblies generally designated 64, a tambour door 66, and a sprocket and counterbalance spring system generally designated 68. The door guide assemblies 64 are tracks that support and guide the ends of the tambour door 66. Each door guide assembly 64 includes a horizontal channel 70, a generally vertical channel 72, and an arcuate channel 74 connecting the horizontal channel to the generally vertical channel to form one continuous door guide. One of the door guide assemblies 64 is attached to the L-shaped support frame member 50 and the other door guide assembly is attached to the L-shaped support frame member 52 with the open sides of the channels facing toward each other.

The tambour door 66 includes ten elongated tambour slats 76. Each elongated tambour slat 76 is a fiberglass tube filled with rigid structural foam 77, except for a section at each end. A shaft 78 and shaft mounting block 80 is secured in the section of each end of each tambour slat 76 that is not filled with foam 77. A roller and bearing assembly 82 with a tire 84 made of rubber or some other material is attached to the free end of each shaft 78. The roller and bearing assemblies 82 are positioned in the door guide assemblies 64 and confine the tambour slats 76 to movement along a path determined by the shape of the door guide assemblies. The tires 84 on the roller and bearing assemblies 82 eliminate noise during movement of the tambour slats in the door guide assemblies 64. A flexible impervious membrane 86 is secured to the side of the tambour slats 76 which faces the marginal sealing surface 48 on the open side 28 of the main tub body 12. The membrane 86 is a laminated sheet made from three layers of fiber cloth in a plastic matrix which provides a smooth surface that is easy to clean and is not damaged by various chemicals, such as bath oils and caustic tub cleaners, that might be used in bath water or to clean bath tubs. The three fiber cloth layers are unidirectional fiber net material that is sold under the trademark KEVLAR owned by New England Ropes Inc. or other material with similar properties. The membrane 86 is attached to the tambour slats 76 by rivets 88, other suitable fasteners, or clamps. The rivets 88 are near the ends of the tambour slats 76 and in the top and bottom tambour slats 76 where they are not normally in contact with water in the bath tub to eliminate possible leaks. The membrane 86 and the rivets 88 hold the ten tambour slats 76 in a side-by-side parallel position relative to each other. The membrane 86 is attached to the tambour slats 76 with the fibers, in the two outer cloth layers of unidirectional fiber net, parallel to the long axes of the tambour slats. The fibers, in the center cloth layer of unidirectional fiber net, are perpendicular to the fibers in the two outer layers and to the long axes of the tambour slats 76.

Figure 24:
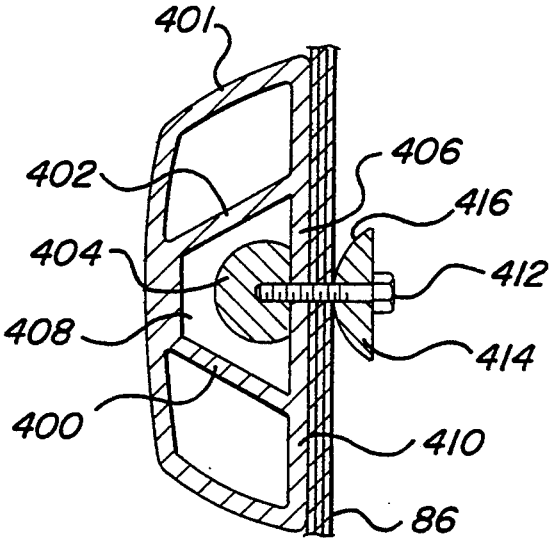

The tambour slats 76 of the tambour door 66 as described above are fiberglass. The tambour slats 76 can also be extruded aluminum tubes 401, as shown in FIG. 24. Fiberglass and aluminum slats both function well. There is no significant difference in weight or strength. One is not, therefore, favored over the other from a functional point of view. However, it takes substantial time to make the fiberglass slats. In relatively expensive labor market areas, extruded aluminum tambour slats 401 are preferred over fiberglass slats 76 because of their lower cost. The aluminum tambour slat 401 has internal reinforcing ribs 400 and 402, as shown in FIG. 24. The reinforcing ribs 400 and 402 are integral with the other portions of the slats 401 and are formed during the extrusion process. A different system is employed for attaching a shaft 404 which supports a roller and bearing assembly 82 with a tire 84 like the shaft 78 described above. The shaft 404 has a flat area 406 on the portion which is inserted into the middle tubular passage 408. The flat surface 406 of the shaft 404 is placed against the inside surface of the inside wall 410 of a slat 401. The shaft 404 is then secured by one or more bolts 412 that screw into the threaded passages in the shaft. The bolts 412 pass through a clamp plate 414, the flexible impervious membrane 86 and the inside wall 410 of the tambour slat 401 before they are screwed into the threaded passages in the shaft 404. The clamp plate 414 clamps the membrane 86 to the aluminum tambour slats 401 and holds the tambour slats parallel to each other. The surface 416 of the clamp plate 414 that contacts the flexible impervious membrane 86 is an arc about an axis that is parallel to the long axis of the aluminum tambour slats 401. The arcuate surface 416 reduces the stress on the membrane 86 when the tambour slats 401 change direction during opening and closing of the tambour door 66. A cap or caps (not shown) can be provided on each end of each tambour slat 401 to close the ends of the middle tubular passage 408 and the two side tubular passages formed in each tambour slat by the reinforcing ribs 400 and 402.

Figure 11:
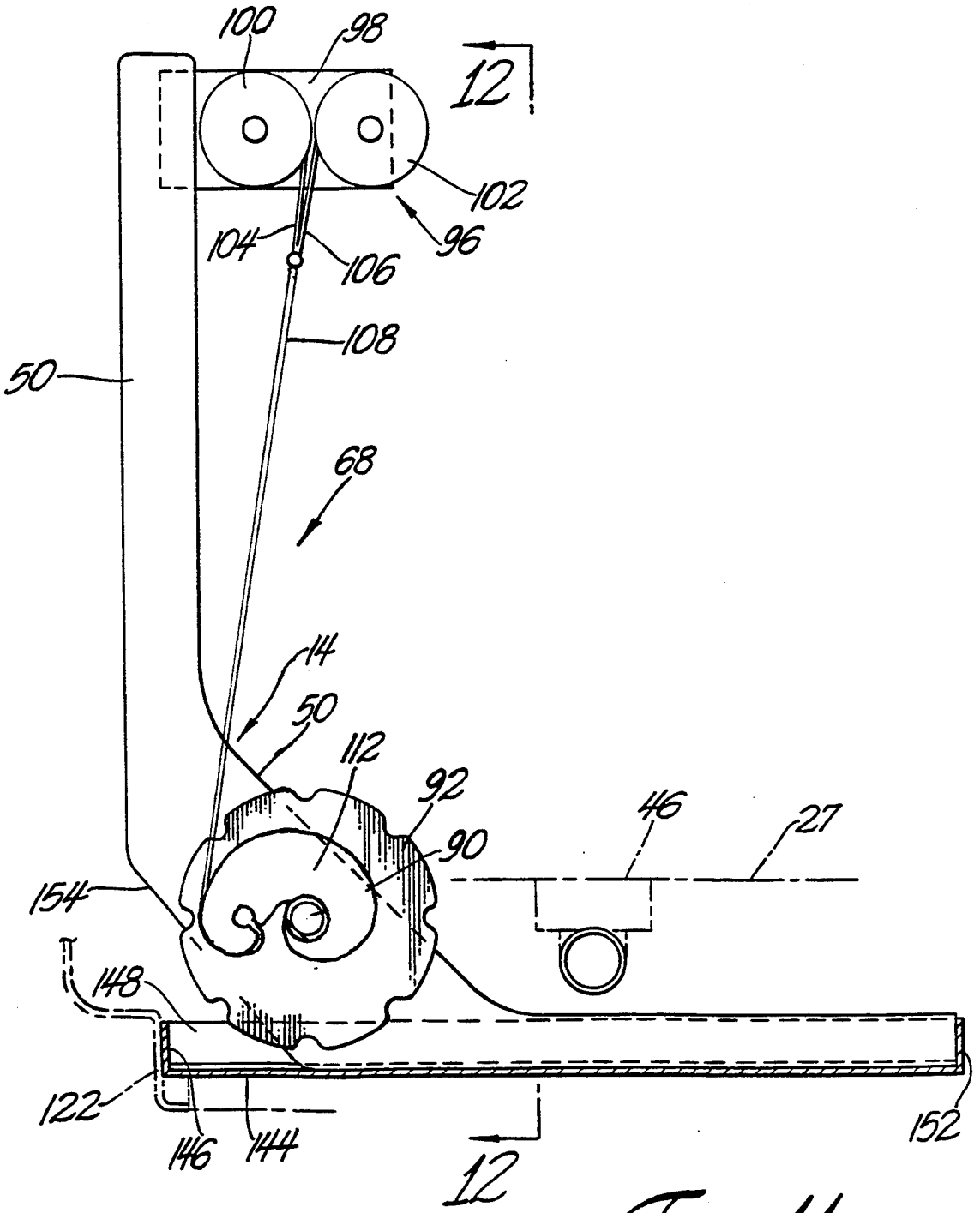
Figure 12:
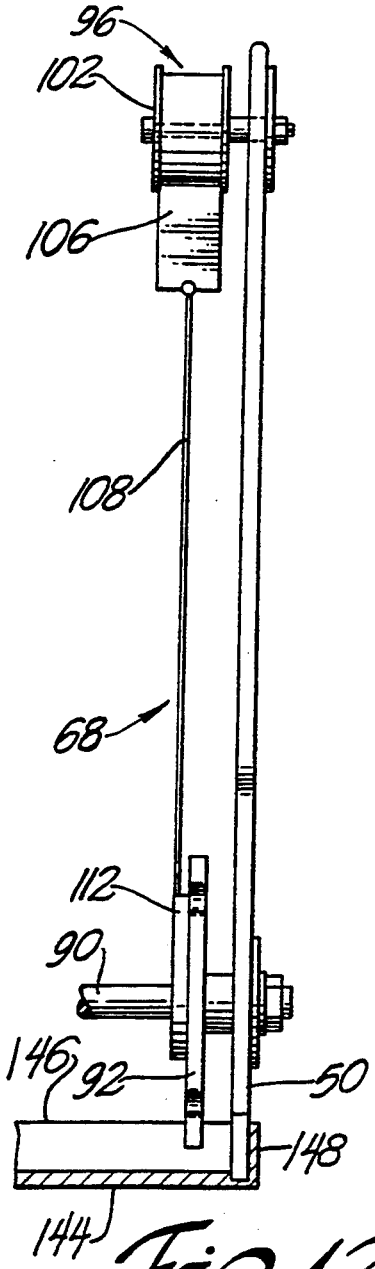

A sprocket and counterbalance spring system 68, as shown in FIGS. 11 and 12, includes a sprocket shaft 90 rotatably journaled on the generally L-shaped support frame members 50 and 52. A sprocket 92 is attached to each end of the sprocket shaft 90 adjacent to the arcuate channels 74 of the door guide assemblies 64. The sprockets 92 engage the shafts 78 or 304 that extend from the ends of each tambour slat 76. The sprockets 92 are secured to the sprocket shaft 90 so that they keep the tambour door 66 in alignment relative to the door guide assemblies 64 and prevent binding of the tambour door. A spacer 94 is provided on each shaft 78 adjacent to a mounting block 80 in the end of each tambour slat 76. The spacers 94 are between the two sprockets 92 when the shafts 90 the spacers are mounted on are in mesh with the sprockets. The spacers 94 thereby center the tambour door 66 between the sprockets 92.

The counterbalance spring assembly 96 of the sprocket and counterbalance spring system 68 include a spring support plate 98 rigidly secured to the upper portion of one of the generally L-shaped support frame members 50 or 52. Two take-up spools 100 and 102 are rotatably attached to the spring support plate 98. A stainless steel ribbon linear force spring 104 is attached to the take-up spool 100 and a stainless steel ribbon linear force spring 106 is attached to the take-up spool 102 as shown in FIG. 12. The linear force springs 104 and 106 tend to coil and rotate the take-up spools 100 and 102 in opposite directions. The linear force spring 104 rolls up into a coil on the take-up spool 100. The linear force spring 106 rolls up into a coil on the take-up spool 102. The force exerted by the linear force springs is substantially constant regardless of position as the springs uncoil from the take-up spools 100 and 102 or coil onto the take-up spools. The free ends of the linear force springs 104 and 106 are attached together by a cable 108. The cable 108 is attached to the sprocket 92 at a point 110 near the perimeter of the sprocket on an eccentric cam 112 on one side of the sprocket. The linear force springs 104 and 106 counterbalance the weight of the tambour door 66 at all positions of the tambour door in the door guide assemblies 64. When the tambout door 66 is fully open and is supported under the floor 27 of the main tub body 12 there is very little weight for the linear force springs 104 and 106 to support. The cable 108 is wrapped around and in contact with all or most of the eccentric cam 112. As the tambour door 66 moves from the fully open position, where it is under the floor 27, toward the fully closed position adjacent to the sealing surface 48, the cable 108 unwinds from the eccentric cam 112 and the linear force springs 104 and 106 wrap around the take-up spools 100 and 102. The eccentric cam 112 increases the effective moment arm as the tambour door is raised. As the tambour door 66 approaches the fully closed position, as shown in FIG. 11, the linear force springs 104 and 106 act on a portion of the eccentric cam 112 with a maximum radius and support the entire weight of the tambour door. This arrangement effectively counterbalances the weight of the tambour door and makes it possible to move the tambour door from the open position to the closed position with a small, essentially constant force. The tambour door 66 can also be closed with a small, essentially constant force.

The door support frame 14 includes a valance generally designated 114 attached to the generally L-shaped support frame members 50 and 52. The valance 114 includes a generally horizontal section 116, vertical end sections 118 and 120, and a recessed toe plate 122 along the bottom. The valance 114 essentially surrounds the open side 28 of the main tub body 12 without reducing the size of the opening for ingress or egress by a bather. The valance 114 forms a portion of the door support frame 14, covers the door guide assemblies 64, and can contact the tambour slats 76 to limit lateral movement of the tambour door 66 away from the sealing surface 48.

Figure 4:
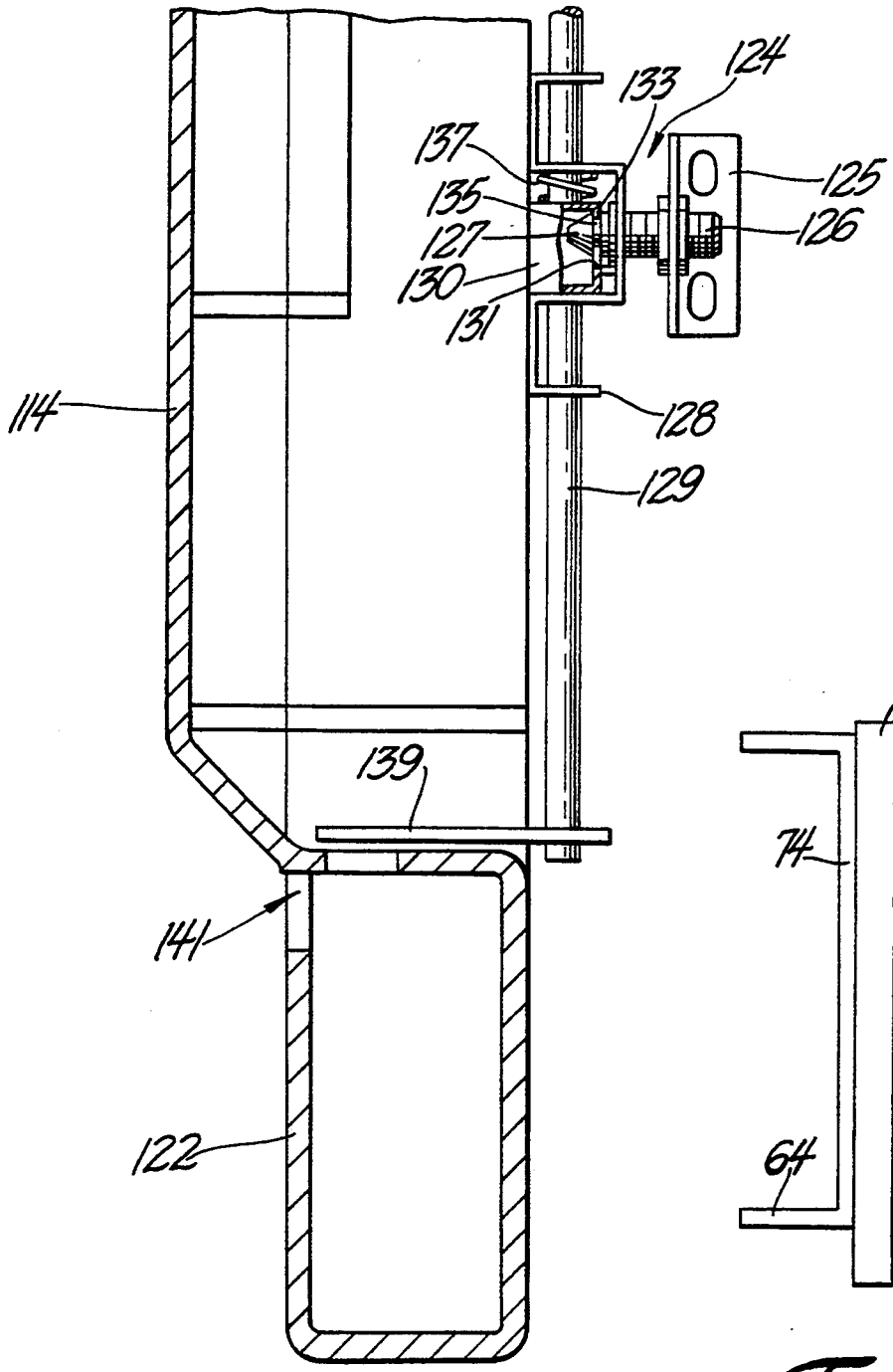
Figure 5:
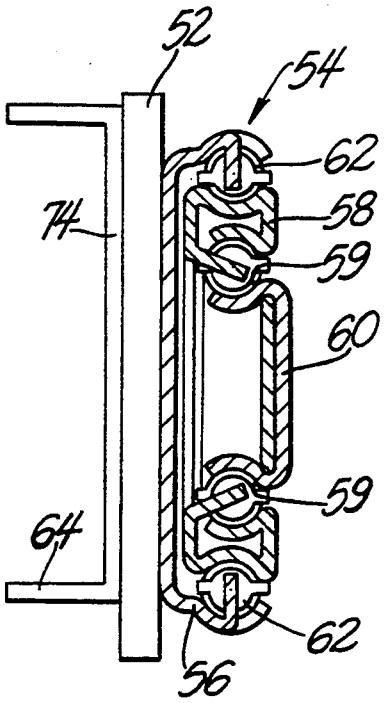

The door support frame 14 is locked into a closed position by a pair of pin slam locks 124 at each end of the valance 114 of the door support frame. Only the lower pin slam lock 124 is shown in FIG. 4. Each pin slam lock includes a bracket 125 secured to the first and second end walls 24 and 26 inside the cavities 30. A pin 126 is screwed into each bracket 125 with a conical end 127 projecting horizontally away from the main tub section 12 and toward the valance 114. A latch support bracket 128 is secured to the door support frame 14 in alignment with each of the four pins 126. A vertical rod 129 passes through the two latch support brackets 128, on the end of the door support frame, which are in alignment with the two pins 126 secured to first end wall 24. An identical vertical rod 129 passes through the two latch support brackets 128, on the end of the door support frame, which are in alignment with the two pins 126 secured to the second end wall 26. A latch 130 with a pin receiving aperture 131 is connected to the rod 129 and positioned within each latch support bracket 128. When the door support frame 14 is moved toward the main tub body 12 on the drawer slides 54, the conical ends 127 of each pin 126 enter a pin receiving aperture 131 and cam the latch 130 to a position which allows the conical end to move into the latch. After the pin 126 has moved all the way into the latch 130 it is in alignment with, a lip 133 of the pin receiving aperture 131 snaps into a groove 135 at the base of the conical end 127 of the pin 126 and locks the door support frame 14 in a closed position. Springs 137 bias the lips 133 of the latches 130 into the grooves 135 to latch the door support frame 14 to the main tub body 12. An arm 139 is provided on the bottom end of each rod 129 as shown in FIG. 4. The arm 139 is lifted to raise the rod 129 and to raise the two latches 130 connected to the rod and release the pins 126. Both rods 129 have to be raised to release all four pins 126 before the support frame 14 can move horizontally away from the main tub body 12. The arms 139 are lifted manually by inserting a finger or a tool through each of the openings 141. Adjustment of the pins 126 in the brackets 125 position the tambour door 66 in the proper position relative to the sealing surface 48. The valance 114 is adjacent to the tambour slats 76 when the tambour door is closed and limits movement of the tambour slats 76 away from the main tub body 12.

Figure 13:
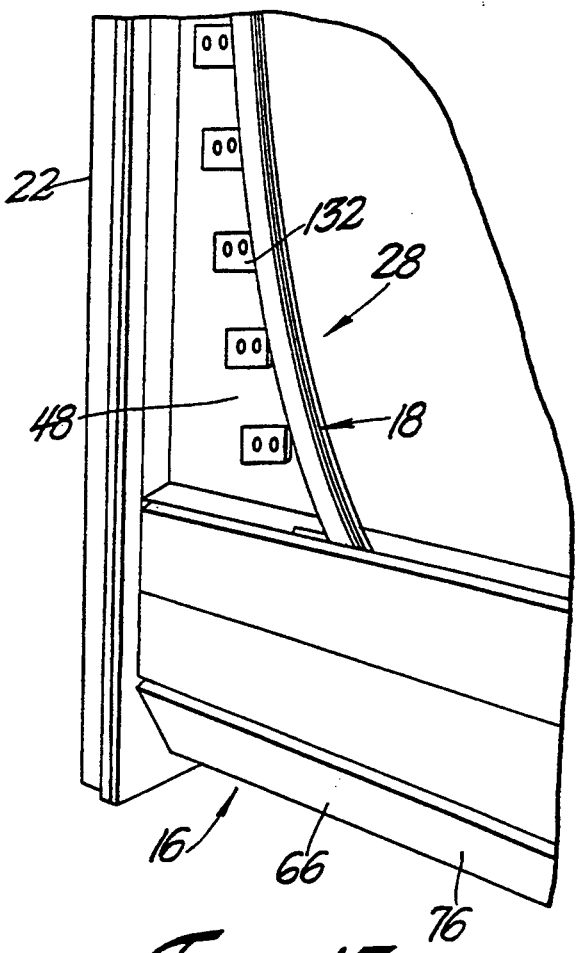
Figure 14:
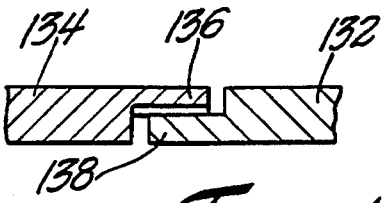
Figure 15:
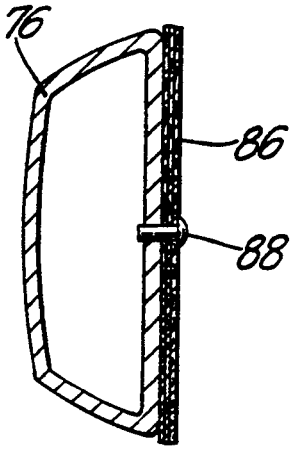
Figure 16:
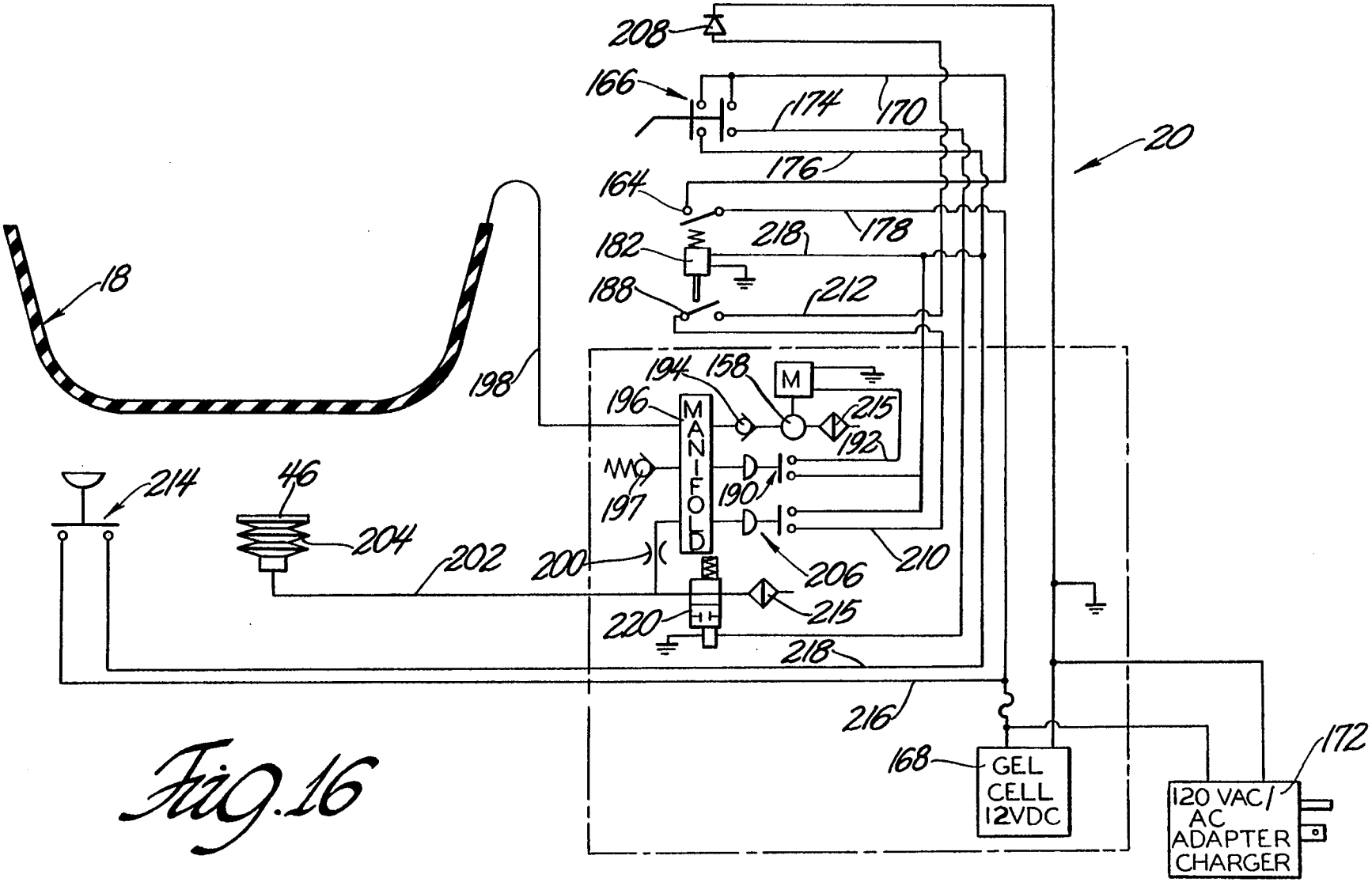

An optional system for limiting lateral movement of the tambour door 66 away from the sealing surface 48 is shown in FIGS. 13 and 14. The optional system includes a plurality of retainer tabs 132 secured to the sealing surface 48 at the ends of the open side 28 and a plurality of retainer tabs 134 attached to the sides of the tambour door 66. A plurality of retainer tabs 132 are also secured to the sealing surface 48 across the bottom portion of the open side 28 of the main tub section 12 and a plurality of retainer tabs 134 are attached to the bottom tambour slat or slats 76 of the tambour door 66. The retainer tabs 134 have an end projection 136 which slides behind an end projection 138 on the retainer tabs 132 when the tambour door 66 is closed and the retainer tabs 132 and 134 are side by side. When the tambour door 66 is fully closed the retainer tabs 132 cooperate with the retainer tabs 134 to limit horizontal movement of the tambour door 66 away from the sealing surface 48.

Figure 6:
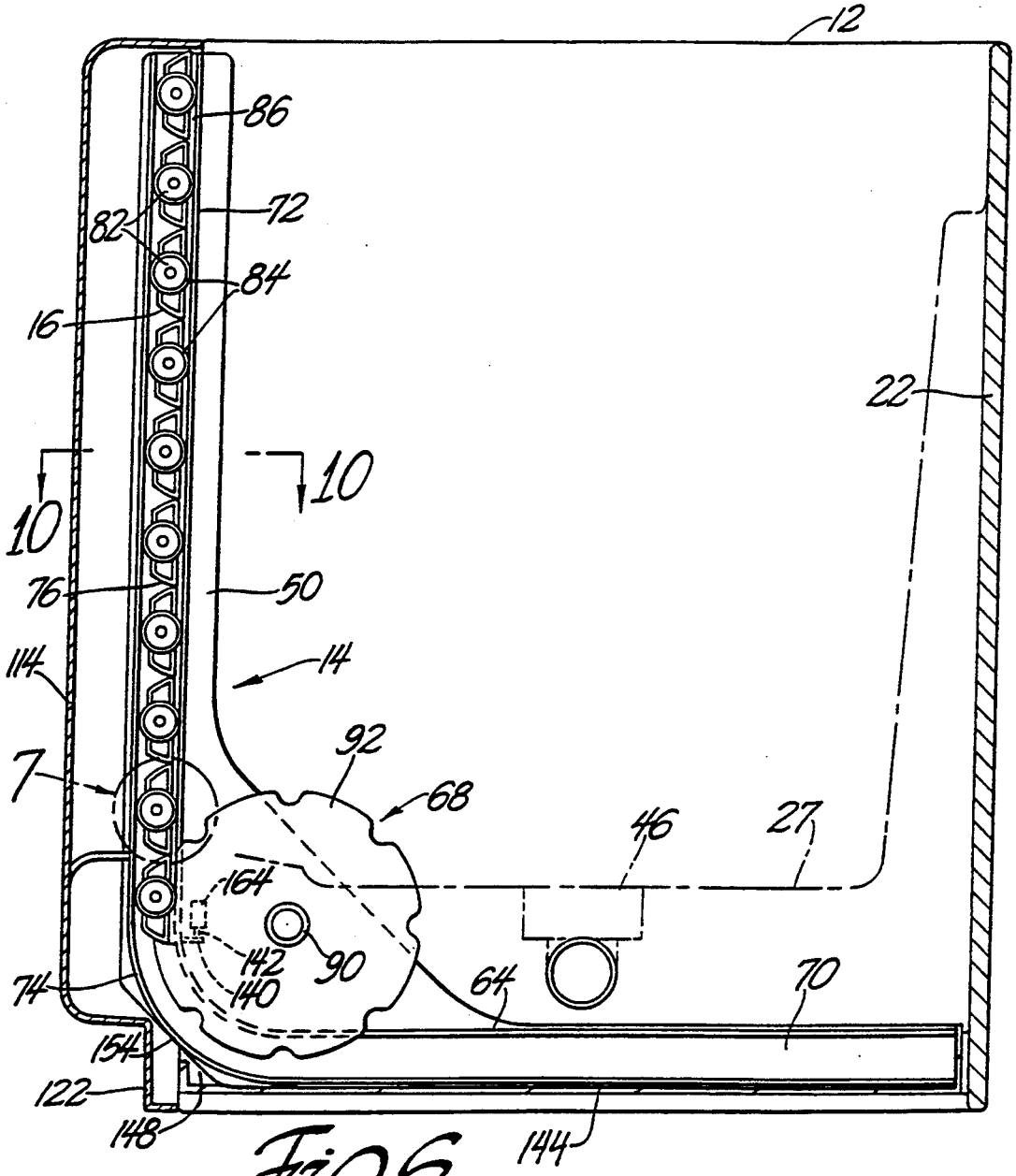
Figure 7:
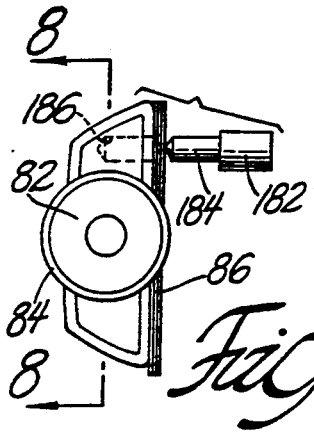
Figure 8:
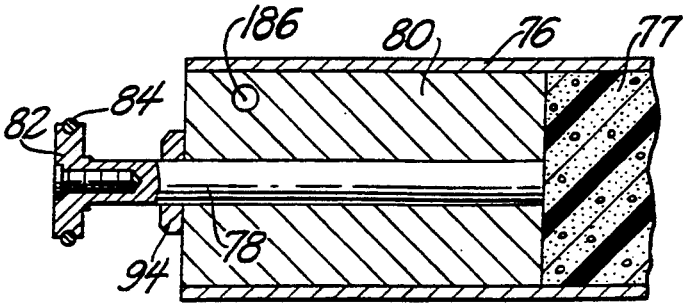

The bottom tambour slat 76 of the tambour door 66 has an attached angle member 140 (FIG. 6) extending inwardly toward the main tub body 12. The bottom tambour slat 76 is strengthened by the angle member 140 and is held adjacent to the main tub body when the tambour door 66 is closed. The angle member 140 also engages a stop 142 on the bottom of the main tub body 12 near the sealing surface 48. The engagement between the angle member 140 and the stop 142 stops upward movement of the tambour door 66 as shown in FIG. 6. Upward movement of the tambour door 66 could also be stopped by retainer tabs 132 and 134 or by contact between the top of the tambour door 66 and the valance 114. The angle member 140 and the stop 142 make contact and stop movement of the tambour door 66 while the pins 78 extending from the bottom tambour slat 76 are in engagement with the sprockets 92. The sprockets 92 remain in mesh with the pins 78 at all times to keep the eccentric cam 112 timed relative to the tambour door 66.

A fiberglass reinforced plastic drip pan 144, shown in FIG. 11, is positioned under the main tub body 12 and the door guide assemblies 64 to catch any water that drips from the tambour door 66. The drip pan 144 slides out with the door support frame 14 when the pin slam locks 124 are unlatched to release the door support frame 14 and the support frame is moved laterally away from the sealing surface 48 on the door slides 54. The fiberglass reinforced plastic drip pan 144 slides back under the main tub body 12 when the door support frame 14 is slid back toward the main tub body and locked into position by the pin slam locks 124. The fiberglass reinforced plastic drip pan 144 has a front wall 146, end walls 148 and 150, and a rear wall 152. The front wall 146 is positioned in a notch 154 between the lower front corner of each generally L-shaped support frame member 50 and 52 and the back side of the toe plate 122 of the valance 114. The L-shaped support frame members 50 and 52 are positioned between the end walls 148 and 150 and partially inside the fiberglass reinforced plastic drip pan 144. If desired the fiberglass reinforced drip pan 144 can be attached to the L-shaped support frame members 50 and 52 by bolts or other fasteners.

Figure 17:
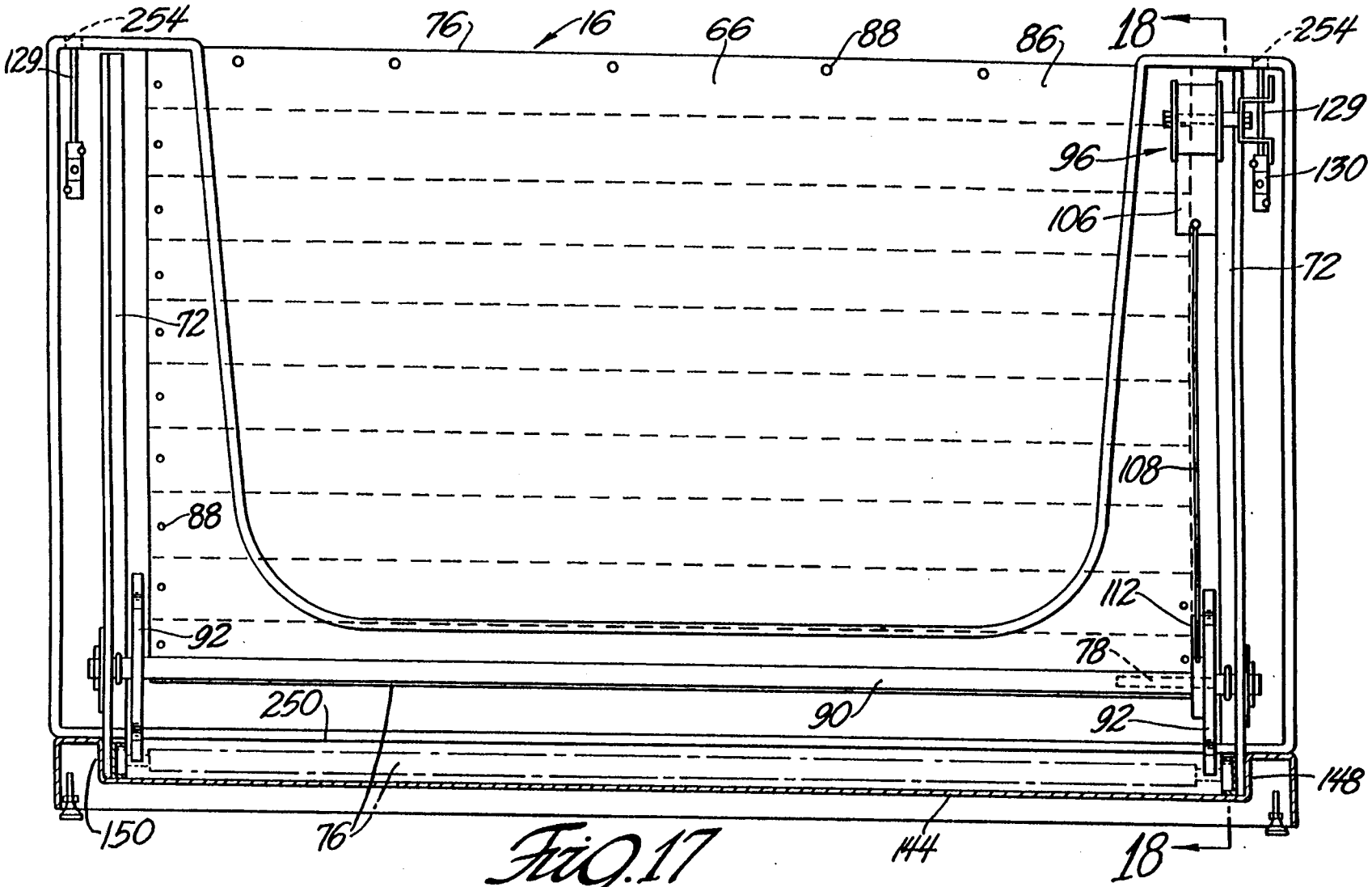
Figure 18:
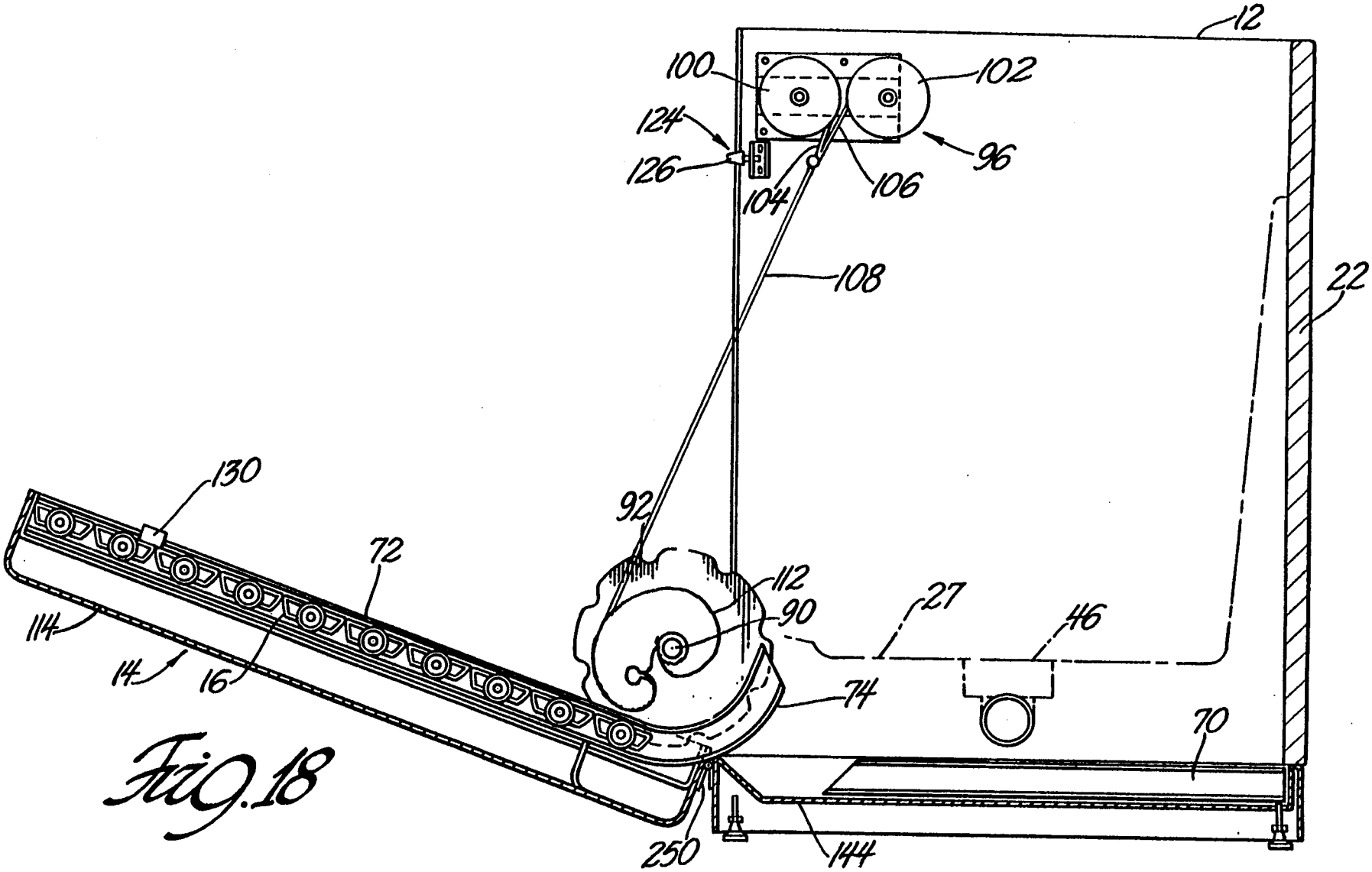

In another embodiment, the door support frame 14 can be pivotally attached to the main tub section 12 as shown in FIGS. 17 and 18. When the door support frame 14 is pivotally attached, the drip pan 144 is an integral part of the main tub section 12. The drip pan 144 is integral with the first end wall 24, the second end wall 26, and the side wall 22. The recessed toe plate 122 is separate from the valance 114 and is an integral part of the drip pan 144 and the main tub section 12. The valance 114 is pivotally attached to the recessed toe plate 122 by a piano hinge 250. The door guide assemblies 64 have horizontal channels 70 that are secured to the main tub section 12 inside the drip pan 144. The vertical channels 72 and the arcuate channels 74 of the door guide assemblies 64 are secured to the valance 114 and pivot with the valance. The L-shaped support frame members 50 and 52 are not required. The two take-up spools 100 and 102 are attached to the first or the second end wall 24 or 26 inside one of the cavities 30 rather than to one of the L-shaped support frame members 50 or 52. With the piano hinge 250 securing the valance 114 to the main tub section 112 along the entire length of the valance, only one pin slam lock 124 is required at each end of the valance. When the pivotally attached door support frame 14 and the valance 114 are locked to the main tub section 12 by the pin slam locks 124, the horizontal channels 70 are adjacent to the vertical channels 72 and the arcuate channels 74 to form continuous door guide assemblies 64. With this construction the vertical rod 129 for each pin slam lock 124 extends up from the latch 130 to the top of the valance 114. The latches 130 are unlatched by inserting a tool or a finger into apertures 254 in the top of the valance and forcing the vertical rods 129 and the attached latches 130 downward to unlatched positions. The springs 137 bias the latches 130 upwardly to a latched position, rather than downwardly, as described above and shown in FIG. 4. A locking system can be provided to prevent inadvertent release of the latches 130 if needed. The pin slam locks 124 are unlocked from the bottom of the valance as shown in FIG. 4 or from the top as shown in FIG. 17. The pin slam locks 124 as shown in FIG. 4 could be mounted to be released from the top if desired and the pin slam locks shown in FIG. 17 could be mounted to be released from the bottom if desired. The elongated tambour slat 76 shown in phantom lines inside the drip pan 144 in FIG. 17 shows the position of the tambour slats when the tambour door 66 is open. When the tambour door 66 is closed as shown in FIG. 17, the lowermost tambout slat 76 is at about the same height as the sprocket shaft 90. The tambour door 66 is to be fully closed when the door support frame 14 is pivoted to the position shown in FIG. 18. When the valance is pivoted down and away from the main tub section 12, there is adequate access for cleaning, adjustment and maintenance.

Figure 3:
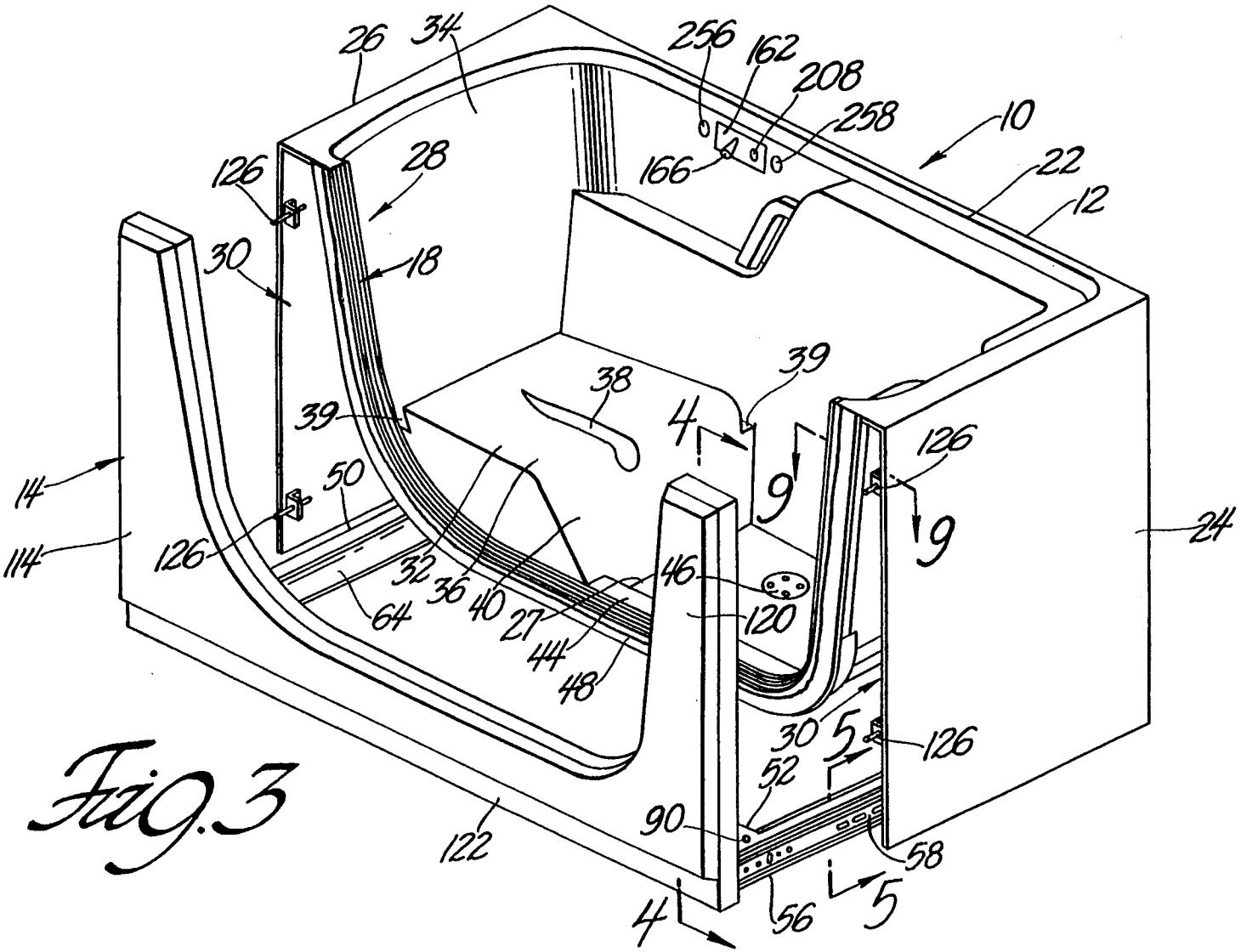

The bath tub 10 is described above with a valance 114 mounted on L-shaped frame members 50 and 52, the frame members 50 and 52 attach to the first end wall 24 and the second end wall 26 by industrial drawer slides 54 and the tambour door assembly 16 attached to the L-shaped frame members. With this arrangement, the valance latches 130 are released and the entire tambour door assembly 16 is moved horizontally away from the main tub body 12 on the drawer slides for cleaning and maintenance, as shown in FIG. 3. The bath tub 10 is also described with a valance 114 pivotally attached to the main tub body 12 and the L-shaped frame members 50 and 52 attach to the valance. With the L-shaped frame members 50 and 52 attached directly to a pivotally mounted valance 114, the tambour door assembly 16 must be in the closed position before the valance 114 can be released and pivoted away from the main tub body 12 for cleaning and maintenance. The bath tub 10 can also have the valance 114 pivotally attached to the main tub body 12 by a hinge 250, the vertical channels 72 and the arcuate channels 74 of the door guide assemblies 64 attach directly to the valance and the horizontal channels 70 secured to the main tub body or section 12, as shown in FIG. 18. With the horizontal channels 70 secured to the main tub body 12, the tambour door 66 must be in the closed position before the valance can be released and pivoted away from the main tub body 12 for cleaning and maintenance.

Figure 20:
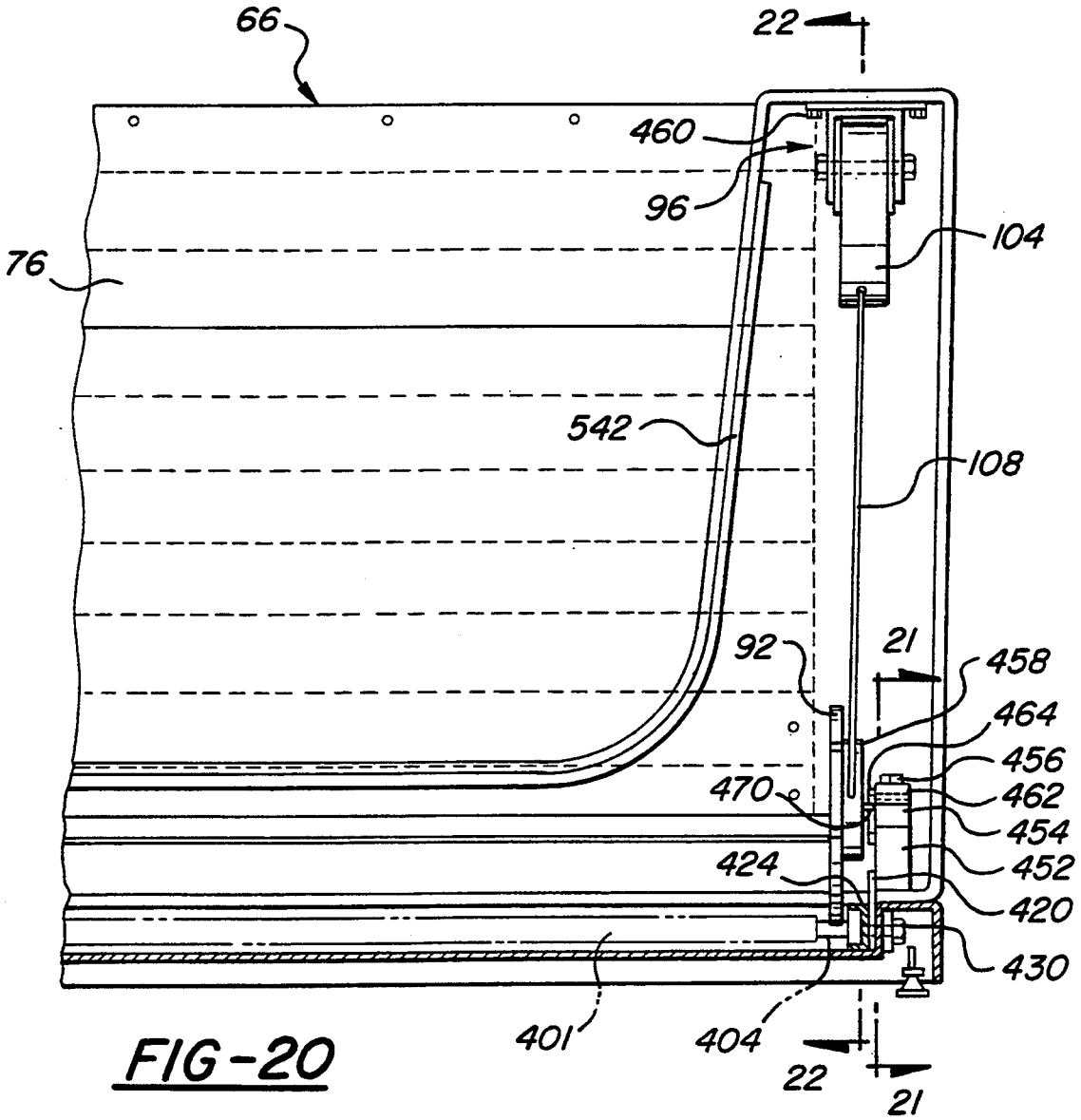
Figure 21:
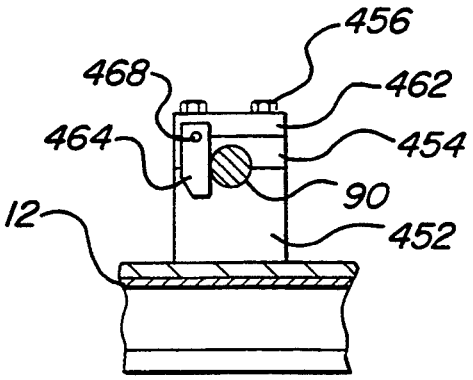
Figure 22:
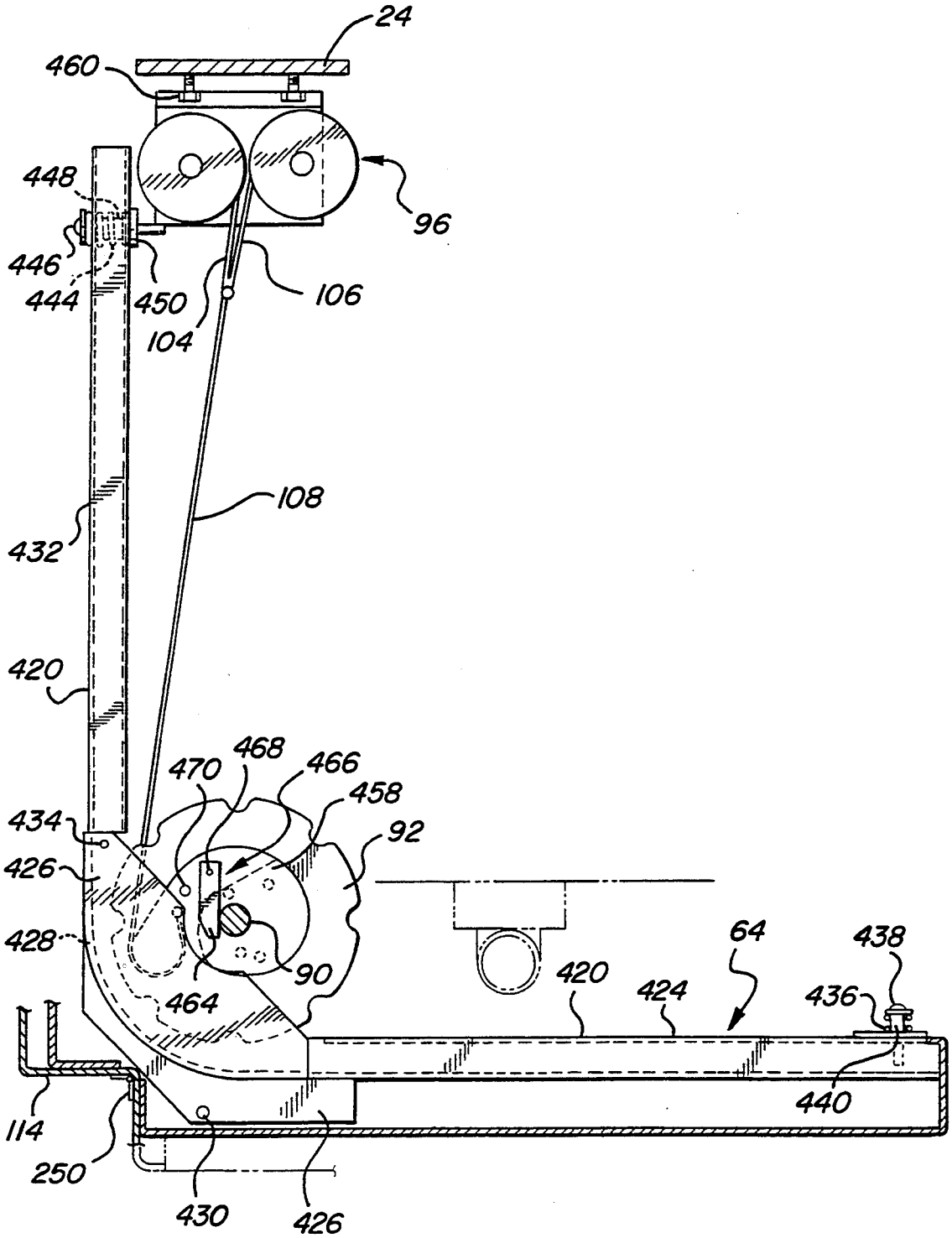
Figure 23:
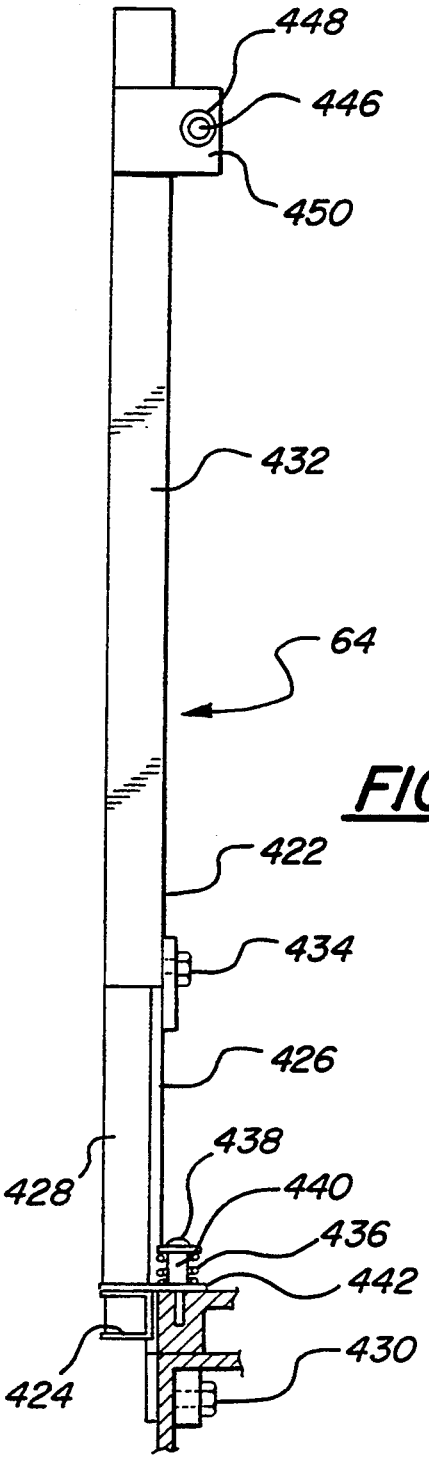

The valance 114 is pivotally attached to the main tub section 12 by a hinge 250 and the door guide assemblies 64 are attached directly to the main tub body 12 as shown in FIGS. 20, 22, and 23 in the preferred embodiment of the invention. In this embodiment, the latches 130 can release the pins 126 and the valance 114 can pivot away from the main tub body 12 with the tambour door 66 in the closed position, the open position or in an intermediate position. Opening the valance 114 and moving the tambour door as required provides sufficient access for most cleaning and maintenance procedures. If necessary, the tambour door 66 can be removed from the door guide assembly 64. Removal of the tambour door 66 from the door guide assemblies 64 is described below.

In another embodiment the door guide assemblies 64 for the tambour door 66, as shown in FIGS. 20, 22, and 23, includes a first track assembly 420 and a second track assembly 422. The first track assembly 420 is mounted on the end wall 24 of the main tub body or section 12 of the bath tub or bathing enclosure 10. The second track assembly 422 is mounted on the other end wall 26 of the bathing enclosure 10. The track assemblies 420 and 422 include a generally horizontal guide 424 with a mounting plate 426 and an arcuate plate 428. The mounting plate 426 is on the end of the generally horizontal guide 424 adjacent to the open side 28 of the main enclosure body 12 and is pivotally attached to the main enclosure body by a pin 430. The generally vertical guide 432 has a lower end that is pivotally attached to the mounting plate 426 by a pivot pin 434. The arcuate plate 428 is rigidly secured to the mounting plate 426 and guides the tambour door 66 between the generally horizontal guide 424 and the generally vertical guide 432. The generally horizontal guides 424 and the generally vertical guides 432 are shown as channel members with their open sides facing toward the track assembly 420 or 422 on the opposite end wall 24 or 26 of the main enclosure section 12. The end of each generally horizontal guide 424 adjacent to the side wall 22 on the main enclosure section 12 is biased downward by a compression spring 436. A spring retainer 438 passes through a plastic bearing 440, the compression spring 436 and a hole in a plate 442 welded to the generally horizontal guide 424 and is anchored in the base of an end wall 24 or 26 of the main enclosure section 12. A plastic bearing 440 is a tubular member which passes through a hole in the plate 442 and serves as a guide bearing to guide the generally horizontal guide when the generally horizontal guide 424 pivots about the axis of the pin 430. The compression spring 436 biases or urges the generally horizontal guide 424 toward a stop surface on the main tub body 12.

The upper end of each generally vertical guide 432 is biased toward the side wall 22 on the far side of the main enclosure section 12 by a compression spring 444. A spring retainer 446 passes through a plastic bearing 448, the compression spring 444, and a hole in a plate 450 welded to the generally vertical guide 432 and is anchored in the upper portion of the end wall 24 or 26 of the main enclosure section 12. The plastic bearing 448 is a tubular member which passes through a hole in the plate 450 and serves as a guide bearing to guide the generally vertical guide when the generally vertical guide pivots about the axis of the pivot pin 434 that pivotally attaches the generally vertical guide 432 to the mounting plate 426. The compression spring 444 biases or urges the generally vertical guide 432 toward a stop surface on the main tub body 12.

The ends of the sprocket shaft 90 in the embodiment shown in FIGS. 20, 22 and 23, are journalled in bearing blocks 452 and 454 that are secured to the base of the end walls 24 and 26 inside the cavities 30 by bolts 456. Two sprockets 92 are rigidly attached to the sprocket shaft 90. The sprockets mesh with the shafts 78 extending from the ends of the fiberglass tambour slats 76 or the shafts 404 that extend from the ends of the aluminum tambour slats 401, shown in FIG. 24. A cam plate 458 is mounted on a sprocket shaft 90 between one of the sprockets 92 and one of the bearing blocks 452 and 454. The cam plate 458 functions like the cam 112 shown in FIG. 11 and described above. A cable 108 is attached to the cam plate 458. The cable 108 is also attached to two stainless steel ribbon linear force springs 104 and 106 of the counterbalance spring assembly 96 that is described in detail above. The counterbalance spring assembly 96, as shown in FIGS. 20 and 22, is attached to the top of the end wall 24 inside the cavity 30 by bolts 460 or some other securing means. A block 462 is secured to the top of the bearing block 454 on the end wall 24. The first stop member 464 of a stop assembly 466 is pivotally attached to the block 462 by a pin 468. The first stop member 464 is a bar that is positioned between the bearing blocks 454 and 462, and the cam plate 458. A second stop member 470 is a pin that extends from the side of the cam plate 458. The second stop member 470 contacts the first stop member 464 as the tambour door 66 approaches a closed position and rotates the first stop member about the axis of the pin 468 until the first stop member contacts the sprocket shaft 90. When the first stop member 464 contacts the sprocket shaft 90 and the tambour door 66 is in a closed position, and the sprocket 92 as shown in FIG. 22 is blocked from rotating clockwise. In this position, the stop assembly 466 holds the torque applied to the sprocket shaft 90 by the counterbalance spring assembly 96 and the cam plate 458. The sprockets 92 are stopped by the stop assembly 466 when the bottom tambour slat 76 or 401 is the only tambour slat in mesh with the sprockets and when the bottom tambour slat can be disengaged from the sprockets. In this position, the tambour door 66 can be manually lifted up and out of the generally vertical guides 432 and separated from the bath tub 10. The tambour door 66 is locked into mesh with the sprockets 92 by being positioned between the sprockets 92 and the arcuate plate 428, except when the stop assembly 466 prevents rotation of the sprocket shaft 90 in one direction. When the tambour door is lowered to the open position, the second stop member 470 contacts the first stop member 464 and pivots the first stop member away from the sprocket shaft 90 thereby allowing the sprocket shaft 90 and the sprockets 92 to rotate more than one complete revolution.

Figure 9:
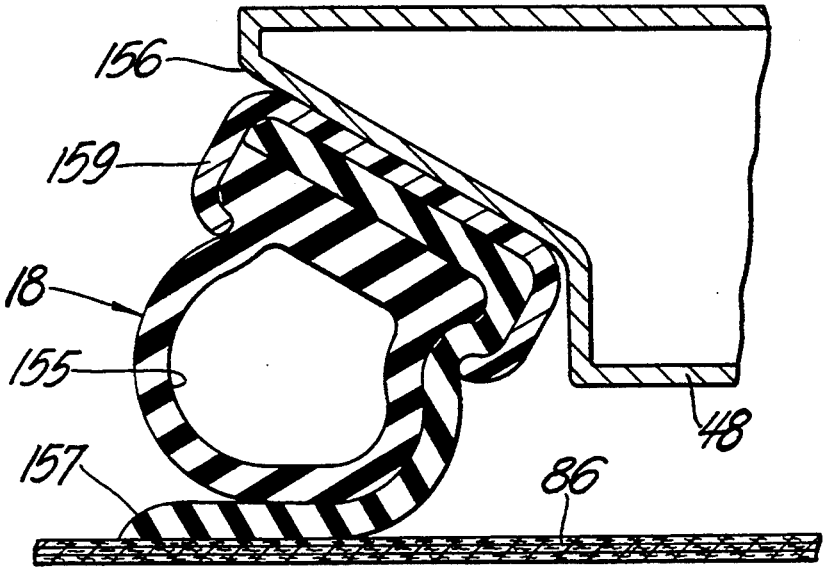
Figure 10:
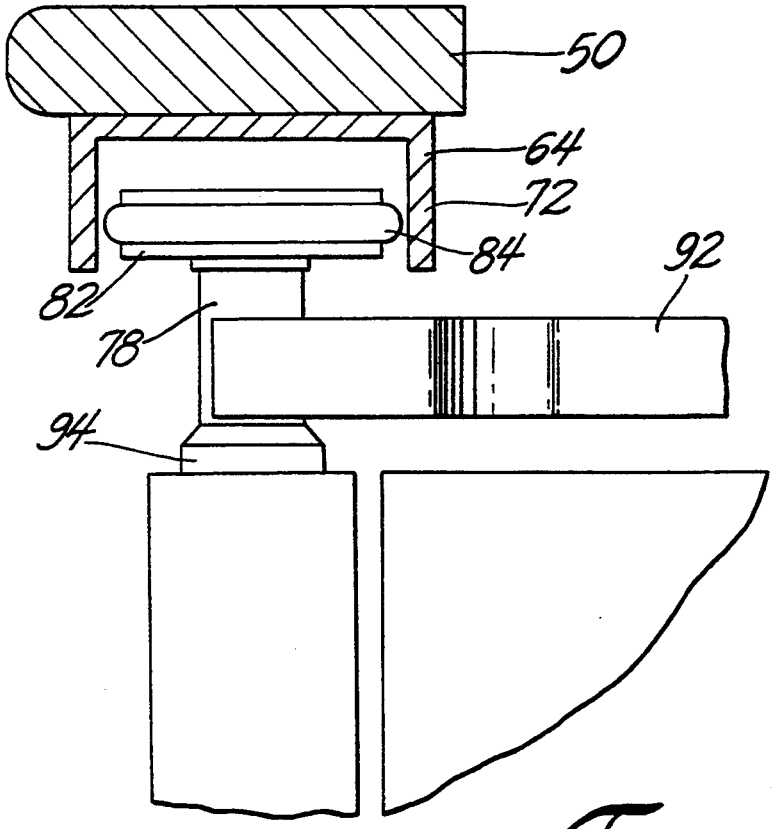
Figure 19:
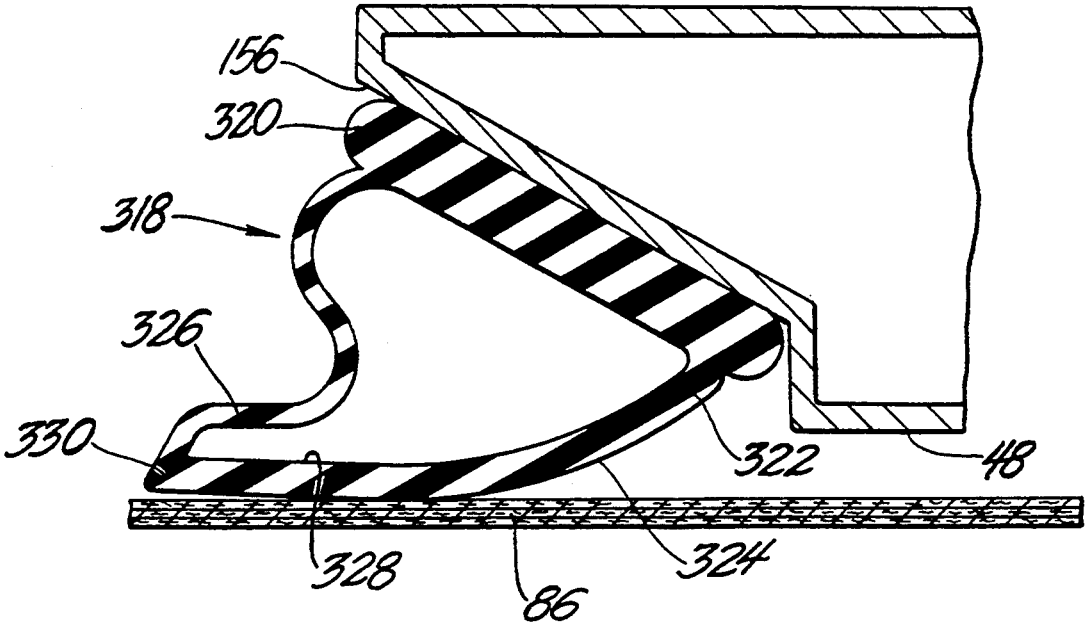
Figure 25:
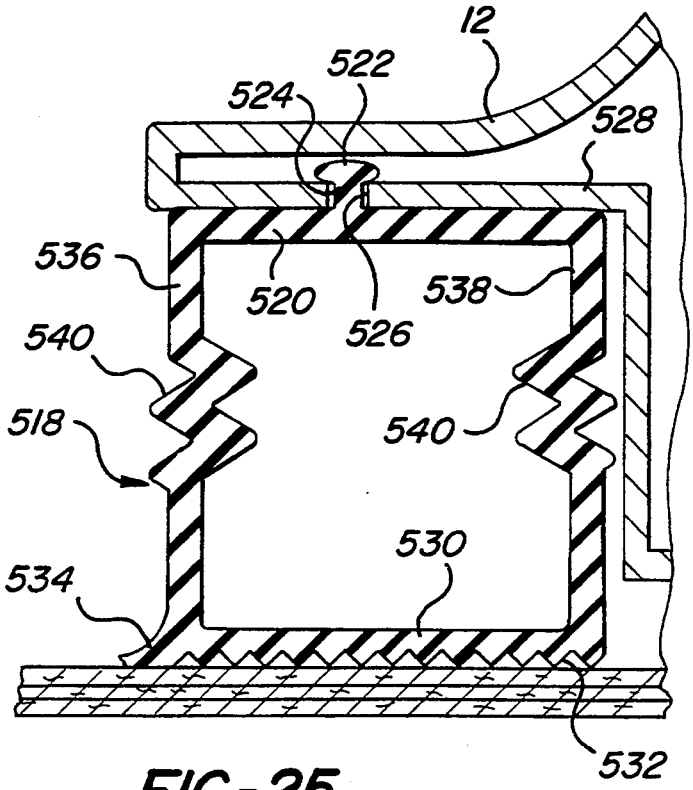

Inflatable door seals are shown in FIGS. 9, 19 and 25. All three door seals 18, 318 and 518 will form a water-tight seal. The seal 18 shown in FIG. 9 is attached to a beveled surface 156 between the sealing surface 48 and inside surfaces of the main tub body 12 that define the ingress and egress opening. The seal 18 can be attached to the beveled surface 156 by adhesives or by mechanical fasteners and a channel 159. The beveled surface 156, as shown in the drawing is at the proper angle relative to the sealing surface 48 to accommodate seal 18. By changing the seal 18, the angle of the beveled surface 156 can be changed and could even be parallel to or perpendicular to the sealing surface 48. The seal 18 as shown in FIG. 9 includes a tubular member 155 that is connected to a fluid pump 158 shown in FIG. 19 and pressurized after the tambour door 66 is closed and before the tub 10 is filled with water. Pressurizing the seal 18 insures that the seal is tight against the flexible impervious membrane 86 of the tambour door 66 and does not leak. The seal 18 also includes a lip seal 157. The lip seal 157 is a pliable member that is held against the tambour door 66 by water pressure from water in the tub and will not leak, even if the tubular member 155 loses pressure. The seal 18 will allow the tambour door 66 to slide relative to the seal and open when the pressure of water against the seal is released by draining water from the tub and compressed fluid in the tubular member 155 of the seal is allowed to escape. A seal 18 which remains in sliding contact with the tambour door 66 when the door is opened is treated with a material that reduces friction to reduce seal wear. However, if desired the tubular member 155 of the seal 18 can be connected to a vacuum pump (not shown) which pumps fluid from the tubular member, thereby collapsing the tubular member, and pulling the tubular member away from the tambour door 66. By pulling the tubular member 155 away from the tambour door 66, pressure exerted on the tambour door by the seal 18 is reduced and the force required to open the tambour door is decreased.

The seal 18 as described above is a two part seal. One part is the tubular member 155. The other part is the lip seal 157. An alternate one piece seal 318 is shown in FIG. 19. The seal 318 includes a semirigid base 320 that is attached to the beveled surface 156. A channel 159 could be used to attach the one piece seal 318 the same way the seal 18 is attached if desired. A wall section 322 extends outwardly from the semirigid base 320. The outer surface 324 of the wall section 322 makes sealing contact with the flexible impervious membrane 86. A flexible wall section 326 extends from the wall section 322 to the semirigid base 320 to complete a tube 328. When the tube 328 is inflated by fluid under pressure, the outer surface 324 is forced into sealing contact with the flexible impervious membrane 86. If the tube 328 is deflated while there is water in the tub 10, water pressure forces the flexible wall section 326 in toward the center of the tube 328 and forces the end 330 of the wall section 322 remote from the semirigid base 320 into sealing contact with the membrane 86 and holds it in contact until water is drained from the tub. The wall section 322 is thicker than the wall section 326. This added thickness provides sufficient rigidity to allow the seal 318 to maintain its shape when the tambour door 66 is opened and closed.

A third door seal 518 is shown in FIG. 25. The door seal 518 is a pneumatic tube with a square or rectangular cross section. The door seal 518 has a back wall 520 which is attached to the main enclosure section 12 by an enlarged end 522 on a projection 524 that extends substantially the length of the door seal 518. The projection 524 extends through a slot 526 in a wall portion 528 of the main enclosure section 12. The enlarged end 522 is on one side of the slot 526 and the back wall 520 is on the other side of the slot. The front wall 530 of the door seal 518 opposite the back wall 520 contacts the impervious membrane 86 on a tambour door 66. The front wall 530 can have a plurality of small ridges 532 to improve sealing. The front wall 530 can also include a lip 534 which is biased toward the impervious membrane 86 by water pressure. The sides 536 and 538 of the door seal 518 have bellows-shaped areas 540 which allow the seal to expand toward the impervious membrane 86. The bellows-shaped areas also allow the front wall 530 to move closer to the rear wall 520.

During use of the tub 10, a person desiring to bathe enters the enclosure through the open side 28, and then the tambour door 66 is raised to the closed position. The seal 18, 318, or 518 is then inflated. The force exerted by the inflated seal 18, 318, or 518 against the flexible impervious membrane 86 in the preferred embodiment shown in FIGS. 20, 22, and 23 moves the tambour door 66 horizontally into contact with a polyethylene strip 542 secured to the valance 114. The upper end of each of the generally vertical guides 432 compresses the compression spring 444 and moves horizontally toward the valance 114. The lower end of the generally vertical guides 432 also move horizontally toward the valance 114 thereby pivoting the generally horizontal guides 424 about the axis of the pins 430 and compressing compression springs 436. The bath tub 10 is then ready to be filled with water. The force exerted on the tambour door 66 by water is transferred directly from the tambour door to the valance 114. Essentially no additional force is exerted on the first and second track assemblies 420 and 422 after the tambour door moves horizontally into contact with the valance 114. After water is drained from the bath tub 10 and the seal 18, 318, or 518 is depressurized, the compression springs 436 and 444 expand, thereby moving the tambour door 66 horizontally away from the valance 114 and partially collapsing the seals.

All three seals 18, 318 and 518 when inflated, seal against the surface of the flexible impervious membrane 86 and squeeze the flexible impervious membrane between the seal 18, 318 and 518 and the tambour slats 76 or 401 thereby preventing the passage of water between the seal and the flexible impervious membrane. The force exerted on the flexible impervious membrane 86 by an inflated seal 18, 318 or 518 causes a frictional force which holds the tambour door 66 closed. The tambour slats 76 or 401 transfer force exerted against the flexible impervious membrane 86 by inflated seals 18, 318 or 518 and by water in the bath tub 10 to the door guide assemblies 64. The door guide assemblies resist at least some of the force. The tambour door 66 can also transfer force to the valance 114 by springing into contact with the valance or by moving horizontally with the vertical guides 432 of the door guide assemblies 64 shown in FIGS. 20, 22 and 24 and described above.

The control system 20 is provided to control the operation of the tub 10. The control system includes a control panel 162. The control panel 162 can be tailored to meet the requirements of the person using the tub 10. However, the functions which must be controlled remain essentially the same. Following entry into the tub 10, the person desiring to bathe manually raises the tambour door 66 to a closed position. If desired or required, however, by the person desiring to bathe, a power source, such as an electric motor (not shown), could be employed to rotate the shaft 90, turn the sprockets 92, and raise the tambour door 66. If an electric motor or other power source were used, the counterbalance spring system 68 may not be required. However, if the counterbalance spring system 68 is used, a smaller electric motor can be used. When the tambour door 66 is closed, a door switch 164 is automatically activated and line 178 is connected to line 170 and the bathe/drain switch 166 is energized. Nothing normally occurs upon activation of the door switch 164. The person desiring to bathe activates the tub bathe/drain switch 166 to the bathe position. With the bathe/drain switch 166 in the bathe position and the tambour door 66 closed, current from a line 170, door switch 164 and line 178 connected to a battery 168 and an adaptor 172 that converts alternating current to direct current, energizes the line 176 and the line 174. Line 174 energizes the normally open solenoid valve 220 thereby causing the valve to close, and deventing the fluid circuit. The line 176 energizes one or more solenoids 182 which lock the tambour door 66 in the closed position by forcing a rod 184 into a bore 186 in the bottom tambour slat 76, if such locks are employed. Movement of the rod 184 of the solenoid 182 into the bore 186 closes the latch switch 188. The line 176 is connected to the line 218 and to the first pressure switch 190 which is normally closed and connects the line 212 to the line 192 which energizes the pump motor M and the pump 158. The pump 158 supplies compressed fluid through a check valve 194 to a manifold 196. The manifold 196 has a pressure relief valve 197 to prevent overpressurization. The manifold 196 supplies compressed fluid to a line 198 that supplies compressed fluid to the inflatable seal 18, 318 or 518 and expands the seal. The manifold 196 also supplies compressed fluid through a restricter 200 and a line 202 to a fluid drain bellows 204 which closes the drain 46. The restricter 200 insures that the seal 18 is pressurized before the drain bellows 204 completely closes the drain 46. When the drain 46 is closed, the bellows 204 pressurized, and the seal 18, 318 or 518 is pressurized, the second pressure switch 206 is closed, line 218 is connected to line 210 which is in turn connected to line 212 through latch switch 188, and a light 208 on the control panel 162 is thereby turned on. The light 208 indicates that the bath tub 10 is ready to be filled and the valves for filling the tub can be opened. The bath tub is filled by opening valve 256 for hot water and valve 258 for cold water. The water which passes through the valves 256 and 258 enters the bath tub 10 through a pipe and fixture (not shown) on the first end wall 24. It should be recognized, however, that the point of entry of water into the tub can be changed to meet the requirements of the person using the bath tub.

The water level switch 214 which is normally open, is closed as the water level in the tub 10 rises. The closed water level switch 214 connects line 216 to line 218 and energizes the solenoids 182 and the pump 158 through pressure switch 190 as long as there is water above a predetermined level in the tub 10. The pressure switch 190 opens and turns off the pump 158 when the pressure in the manifold reaches an operating level. If the pressure in the manifold 196 drops below a predetermined level, the pressure switch 190 closes and the pump 158 pumps fluid into the manifold.

A bather activates the tub bathe/drain switch 166 to the drain position after completing a bath. This activation of the bathe/drain switch 166 breaks the connection between the lines 170 and 178 from the power source to the line 176 and the line 218 to the solenoids 182. However, the solenoids 182 and the pump 158 remain energized through the lines 216 and 218 and the water level switch 214 thereby keeping the tambour door 66 locked or held in the closed position and sealed. Disconnection of the line 170 from the line 174 by moving the tub bathe/drain switch 166 to a drain position de-energizes the solenoid valve 220. The solenoid valve 220 is opened when it is de-energized to vent pressurized fluid from the fluid drain bellows 204 through the filter 215 and thereby drain water from the tub 10. The restricter 200 and the operation of pump 158 through pressure switch 190 keeps the tubular member 155 of the tub seal 18 pressurized while water drains from the tub. When the water level in the tub drops below the level of the bottom of the tambour door 66, the water level switch 214 is opened. Opening the water level switch 214 de-energizes the solenoids 182 and unlocks the tambour door 66, if a solenoid is employed to lock the tambour door, and de-energizes the pump 158. The restricter 200 allows compressed fluid to escape from the tub seal 18, 318 or 518 and the tambour door 66 can be manually opened by pressing down on the top tambour slat 76. When the tambour door opens, the door switch 164 opens. If desired, a fluid evacuation pump (not shown) can be provided to pump fluid from the tubular member 155 of the seal 18, 318 or 518 after the water level switch opens.

Filters 215 can be provided to filter fluid drawn into the system by the fluid pump 158 or through solenoid valve 220. Filters 215 can also be used to muffle fluid escaping from the solenoid valve 220. Fluid would only be drawn through the solenoid valve 220 when a fluid evacuation pump is connected to the manifold 196.

The primary power source for the control system 20 is through the adaptor 172 that converts alternating current to direct current. In the event that there is a power failure which cuts off power from the adaptor 172, the gel cell battery 168 will supply current to operate the control system 20. In the unlikely event that there is a failure of both power sources, the solenoid valve 220 will open, and the solenoids 182 will be de-energized. When the solenoid valve 220 is open, the drain bellows 204 is depressurized thereby opening the drain 46 and the compressed fluid in the tub seal 18 escapes. De-energizing the solenoids 182 allows return springs in the solenoids to withdraw the rods 184 from the bores 186 in tambour slats 76 thereby unlocking the tambour door 66. The tambour door 66 can then be opened. This design of the solenoid valve 220 and the solenoids 182 insures that a bather is not locked in the bath tub 10 even if there is a complete electrical failure.

The fluid pumped into the manifold 196 by the pump 158 is preferably air. However, another gas could be used if desired. It would also be possible to use a liquid to operate the drain bellows 204 and to pressurize the seal 18.

The bath tub 10 has been described above as a stationary unit that can be moved through standard sized doors and installed in a space for a standard-size conventional bath tub. The bath tub 10 can also be mounted on a wheeled carriage and transported to various locations where a person desires to bathe. When the bath tub 10 is mounted on a wheeled carriage, a holding tank for warm water, as well as a holding tank for waste water, can be mounted on the carriage with the bath tub. Pipes with quick disconnects could also be employed to supply water to a tub and to carry waste water from the tub. When pipes with quick disconnects are used, holding tanks for clean water and for waste water are not required. However, with the bath tub 10 mounted on a carriage and with pipes having quick disconnects, it is generally necessary to add a pump for waste water removal so that waste water can be pumped up and out of the tub when a floor drain is not available. An electrical connection for the waste water pump is also required.

The control system 20 could, if desired, include a microprocessor. With a microprocessor it would be possible to expand the control functions to include water temperature, a power door opener, timers, pumps, lights, water level and others. Water temperature control could include inlet water temperature control as well as control of heaters to maintain or increase water temperature. Timers could automatically open the drain and the door after a person has been in the tub the desired time and could send a signal to a remote location indicating that the bather is ready to leave the tub. Pumps could provide a whirlpool with a programmed therapeutic action to fit the requirements of a person using the tub. Water level control could control water level according to the size of a bather and to meet the therapeutic requirements of a bather.

The invention has been described in connection with various embodiments, but is intended to be illustrative rather than definitive thereof and the true scope of the invention is defined by the following claims.

We claim:

1. A bathing enclosure having side access to facilitate ingress and egress including a main enclosure section with a fixed side wall, a pair of fixed end walls integral with the side wall, a bottom wall integral with the side and end walls, a drain valve in the bottom wall and an open side with a marginal sealing surface on a side of the main enclosure section opposite the fixed sidewall; a first track assembly with a generally horizontal guide pivotally attached to the main enclosure section, and with a generally vertical guide attached to the main enclosure section and movable relative to the main enclosure section and urged toward the main enclosure section; a second track assembly with a generally horizontal guide attached to the main enclosure section in a position laterally spaced from and parallel to the generally horizontal guide of the first track assembly, and with a generally vertical guide movable relative to the main enclosure section and urged toward the main enclosure section and having a lower end pivotally attached to the generally horizontal guide of the second track assembly, said vertical guide of the second track assembly being laterally spaced from and parallel to the generally vertical guide of the first track assembly; a tambour door with a plurality of parallel tambour slats traveling in and retained by the first and second track assemblies, a flexible impervious membrane attached to at least some of the parallel slats and movable with the slats between a position generally below the bottom wall of the main enclosure section in which the open side of the enclosure is open and a position adjacent to the marginal sealing surface on the main enclosure section in which the open side of the main enclosure section is closed; a seal attached to the main enclosure section which seals between the main enclosure section and the flexible impervious membrane; and a valance mounted on the main enclosure section adjacent to the generally vertical guides of the first and second track assemblies with the tambour door between the valance and the seal when the tambour door is in a closed position and wherein the valance is operable to contact the plurality of parallel slats to restrain movement of the slats horizontally away from the main enclosure section.

2. A bathing enclosure as set forth in claim 1 wherein the generally horizontal guide of the first track assembly is urged in one direction about its pivotal attachment, the generally vertical guide of the first track assembly has an upper end urged toward the main enclosure section and wherein the force that urges the generally horizontal guide of the first track assembly to pivot about its pivotal attachment to the main enclosure section urges the lower end of the generally vertical guide of the first track assembly toward the main enclosure section; the generally horizontal guide of the second track assembly urged in one direction about its pivotal attachment, the generally vertical guide of the second track assembly has an upper end urged toward the main enclosure section and wherein the force that urges the generally horizontal guide of the second track assembly to pivot about its pivotal attachment to the main enclosure section urges the lower end of the generally vertical guide of the second track assembly toward the main enclosure section.

3. A bathing enclosure as set forth in claim 2 wherein the seal which seals between the main enclosure section and the flexible impervious membrane includes an inflatable tube.

4. A bathing enclosure as set forth in claim 3 wherein the first and second track assemblies are biased toward the main enclosure section with sufficient force to move the tambour slats out of contact with the valance when the inflatable tube in the seal is deflated.

5. A bathing enclosure as set forth in claim 1 wherein the seal which seals between the main enclosure section and the flexible impervious membrane includes an inflatable tube.

6. A bathing enclosure as set forth in claim 5 wherein the first and second track assemblies are biased toward the main enclosure section with sufficient force to move the tambour door slats out of contact with the valance when the inflatable tube in the seal is deflated.

7. A bathing enclosure as set forth in claim 1 wherein the generally horizontal guide and the generally vertical guide of the first track assembly and the generally horizontal guide and the generally vertical guide of the second track assembly include channel members and the tambour door has rollers rotatably attached to at least some of the tambour slats and positioned in the channel members to guide the tambour door.

8. A bathing enclosure as set forth in claim 1 including sprocket teeth engaging surfaces on opposite sides of the tambour door, a shaft rotatably journalled on the main enclosure section, a first sprocket attached to the shaft adjacent to the first track assembly and in mesh with the teeth engaging surfaces on the tambour door, a second sprocket attached to the shaft adjacent to the second track assembly and in mesh with the teeth engaging surfaces on the tambour door.

9. A bathing enclosure as set forth in claim 8 including a stop assembly having a first stop member mounted on the main enclosure section and a second stop member mounted on the shaft with the first and second sprockets and wherein the second stop member is operable to contact the first stop member when the tambour door is in a closed position and prevent further rotation of the sprockets in one direction.

10. A bathing enclosure as set forth in claim 9 wherein the first stop member is a bar that is pivotally mounted on the main enclosure section and that is free to rotate in response to contact with the second stop member as the tambour door approaches the fully open position thereby permitting the shaft, the first sprocket and the second sprocket to rotate more than one full revolution.

11. A bathing enclosure as set forth in claim 9 wherein the tambour door can be disengaged from the first and second sprockets and moved vertically in the generally vertical guides of the first and second track assemblies when the tambour door is in a closed position and rotation of the shaft and the first and second sprockets in one direction is blocked by the stop assembly.

12. A bathing enclosure as set forth in claim 1 wherein the valance is mounted on the main enclosure section by a hinge and a latch system and wherein the latch system can be unlatched to allow the valance to pivot away from the track assemblies.

* * * * *